US009896227B2

(12) United States Patent
Nowzari

(10) Patent No.: US 9,896,227 B2
(45) Date of Patent: Feb. 20, 2018

(54) BEVERAGE BOTTLE WITH A RESEALABLE STORAGE COMPARTMENT

(71) Applicant: Nader Nowzari, Richmond Hill (CA)

(72) Inventor: Nader Nowzari, Richmond Hill (CA)

( * ) Notice: Subject to any disclaimer, the term of this patent is extended or adjusted under 35 U.S.C. 154(b) by 83 days.

(21) Appl. No.: 14/121,408

(22) Filed: Sep. 2, 2014

(65) Prior Publication Data

US 2014/0374370 A1 Dec. 25, 2014

Related U.S. Application Data

(63) Continuation-in-part of application No. 13/986,132, filed on Apr. 4, 2013, now abandoned.

(51) Int. Cl.

| | |
|---|---|
| ***B65D 1/04*** | (2006.01) |
| ***B65B 5/06*** | (2006.01) |
| ***G09F 3/02*** | (2006.01) |
| ***B65D 23/14*** | (2006.01) |
| ***B65D 25/20*** | (2006.01) |
| ***B65D 77/24*** | (2006.01) |
| *B65D 23/12* | (2006.01) |
| *B65D 81/32* | (2006.01) |

(52) U.S. Cl.

CPC ..... *B65B 5/06* (2013.01); *B65D 23/14* (2013.01); *B65D 25/205* (2013.01); *B65D 77/24* (2013.01); *G09F 3/02* (2013.01); *B65D 1/04* (2013.01); *B65D 23/12* (2013.01); *B65D 81/32* (2013.01); *G09F 2003/0273* (2013.01)

(58) Field of Classification Search

CPC ..... B65D 23/14; B65D 77/24; B65D 25/205; B65D 23/12; B65D 1/10; B65D 81/32; B65B 5/06; G09F 2003/0273; G09F 3/02

USPC ..... 220/23.4, 503, 940, 840, 524, 23.83; 215/6, 10, 383; 426/120; 206/217

See application file for complete search history.

(56) References Cited

U.S. PATENT DOCUMENTS

| | | | | |
|---|---|---|---|---|
| 180,132 | A * | 7/1876 | Bastine et al. | 215/6 |
| 3,732,999 | A * | 5/1973 | Rounkles | B65D 1/04 215/6 |
| 4,795,065 | A * | 1/1989 | Ashizawa et al. | 222/541.5 |
| 2004/0226904 | A1* | 11/2004 | Schroeder | 215/6 |
| 2008/0296246 | A1* | 12/2008 | Chow | 215/6 |

FOREIGN PATENT DOCUMENTS

| | | | | |
|---|---|---|---|---|
| CA | 2414843 | * | 1/2002 | B65D 23/14 |
| CA | 2415843 | * | 1/2002 | B65D 23/14 |

* cited by examiner

*Primary Examiner* — Fenn C Mathew
*Assistant Examiner* — Elizabeth Volz

(57) ABSTRACT

A combination container for a consumer product consisting of a body providing a primary compartment for containing a primary product, the body having a sidewall, a secondary compartment forming a cavity recessed into the body, one or more secondary products pre-packaged in a secondary product package being located within the cavity of the secondary compartment and a label over the secondary product package.

10 Claims, 20 Drawing Sheets

BEVERAGE BOTTLE WITH A RESEALABLE STORAGE COMPARTMENT

This application is a continuation in part of Ser. No. 13/986,132 , filed Apr. 4 2013 which was a continuation in part of Ser. No. 13/374,951 filed Jan. 25, 2012 which was a Continuation in Part of Ser. No. 13/064,246 filed Mar. 14, 2011, which to was a Continuation in Part of Ser. No. 12/778,707 filed May 12 2010, which was in turn a Continuation in Part of Ser. No. 12/076,619 filed Mar. 20 2008, each being entitled, "BEVERAGE BOTTLE WITH A RESEALABLE STORAGE COMPARTMENT", inventor Nader Nowzari.

FIELD OF THE INVENTION

The present invention relates generally to combination containers for consumer products, such as beverage bottles and, more specifically, to a combination container forming a primary product compartment and having a secondary item storage compartment for storing a secondary item such as a promotional product.

BACKGROUND OF THE INVENTION

Promotional products are commonly used by businesses to increase public awareness of their goods and services. In respect to packaged foods, such as cereals and potato chips, manufacturers can easily include the promotional products within the packaging at the time of manufacture. Following the purchase of such packaged foods, the user may open the packaging and remove the promotional product for their use and enjoyment. Thus far, manufacturers have not been provided with a suitable approach for providing combination containers having secondary exterior compartments for secondary products which accompany a primary product package. An existing approach is to secure a secondary product to a hang tag around the neck of the primary container, such as a beverage bottle. Manufacturers have discovered that this approach is problematic for the reason that consumers may easily remove the secondary product from the primary container without having to purchase the associated primary product.

Secondary products are increasingly used at sporting and entertainment events to encourage spectators to attend and support the participants in the subject event. In view of the increased security conditions at most public sporting and entertainment events, spectators are routinely not permitted to bring banners and other novelty secondary products to the events. Without banners or novelty secondary products, spectators are often unable to fully enjoy and participate in the excitement of an event. Similar situations arise with many other cases where consumers may be purchasing a primary product, and require a secondary product to be supplied which accompanies the primary product. For example, take out foods, as primary products, supplied in primary containers, may require secondary products such as cutlery, condiments, cleansing cloths and the like.

In the past, these secondary items are often available only at a service counter, or may require extra handling by staff at the cash register.

This will slow up the handling of customers, and require service personnel to be occupied in clearing service counters, restocking with secondary items and the like.

One form of secondary item package is shown in U.S. Pat. No. 5,351,851 inventor D A Powell granted Oct. 4 1994. In that patent the intent was, apparently to provide a combination package, with a recess for a secondary item, and a clear film covering the recess and holding the item in the recess.

However, It is also necessary that the entire package can be produced, assembled and labeled in an efficient and repeatable fashion, without downtime on the production line.

Where a secondary item is simply placed in the recess, it is found that the item can slip around and move during handling. The item may be moved in such a way that it can no longer be identified by the consumer.

It is found desirable that the item may be placed in the recess and that this placement will remain unchanged during the remaining packaging operations, and thereafter during subsequent handling, until it reaches the hands of the consumer.

It is also found that, during the movement along the packaging line, the rapid movement of such packages, particularly containers for beverages, is such that the secondary item readily becomes displaced from the recess. This results in failure of the packaging process, and downtime on the line, while the problem is resolved.

A further problem with the marketing of bottles or packages with exterior depressions, is in the labeling of the product. Typically such products will be labeled with a label made of paper or thin thermoplastic printed with logos and names of the product and contents.

Where the bottle provides a firm exterior profile, the label is simply wrapped around the bottle and adhered to it. However where there is a depression on the exterior of the bottle, then the label will not be supported in the area of the depression, consequently it will be flexible, and being of thin material is easily damaged.

Products with damaged labels will not be acceptable to consumers, since they appear to have been damaged.

Accordingly this problem must be addressed in order to provide an acceptable beverage container with a secondary item package in the exterior.

Preferably the secondary item package will be of a predetermined size and shape such that it fits readily within the recess of the container, and can be handled automatic robotic machinery on the bottom filling line.

Preferably the secondary item package will have an outer cover panel which is profiled and contoured so as to simulate the contour of the exterior of the bottle or primary package, and thus provide support for a package label.

These problems are not addressed in U.S. Pat. No. 5,351,851, which may account for its apparent lack of commercial success.

In view of the foregoing, there is a need for an improved combination container, such as a beverage bottle for example, having a storage compartment for storing one or more secondary products. The combination container of the present invention may be offered by manufacturers and other businesses to enable users, such as spectators, to utilize the one or more secondary products and to actively participate in the sporting or entertainment event, for example. The combination container of the present invention may also be used by a user in a conventional manner to quench their thirst and thereby further enhance their enjoyment of the sporting or entertainment event.

SUMMARY OF THE INVENTION

The present invention comprises a combination container having a primary compartment for a primary product, which, may for example be a food, a beverage, or any other such product that may be sold to consumers, which in this case is shown and described as a beverage bottle. Such a bottle has a body for containing a liquid beverage, the body having a sidewall extending between a neck and a base. This invention is also applicable to a food or beverage carton, such as a milk or juice carton.

A secondary item compartment is formed as a cavity or depression in the exterior of the bottle, in which the body of the bottle is recessed or depressed inwardly, to provide an outwardly open cavity and one or more secondary items, which may be some kind of a secondary product in many case, is disposed and stored within the cavity of the secondary compartment. The secondary compartment has a cavity wall extending into the body, the cavity wall defining the cavity for storing the one or more secondary products.

Preferably the secondary item is secured in position in the recess or compartment by an adhesive compound.

The adhesive is a release type material, such that the adhesive holds the item in the cavity to enable packaging operations to proceed smoothly, and to hold the item during handling so that it can be identified by a consumer.

The adhesive is temporary, and the item is easily separable from the cavity by the consumer, after purchase.

In a further aspect of the present invention, the base of the beverage bottle is formed with an outer recess, located more or less centrally between the top and bottom of the bottle, which recess defines the secondary compartment.

A semi-rigid cover panel is formed and fitted within the mouth of the outer edge of the recess and provides a cover for the recess and will secure the item. The cover may be in the form of a panel formed for example, of card stock, or if desired, a resilient thermoplastic formed into an arcuate curve matching the profile of the bottle itself.

Preferably, the recess will be formed with a ledge along its outer edge adjacent to the periphery of the bottle. The panel will be cut and shaped so as to fit within the open side of the recess, and lie on the ledge.

The item may be anything from a snack, or a badge, or a simple alcohol-based hand cloth, for example.

In a first embodiment of the present invention, the one or more secondary products may comprise of a banner adapted to be removed from the secondary compartment and unfurled. The banner is furled around one or more telescopic members and stored within the secondary compartment.

In a second embodiment of the present invention, the one or more secondary products comprise a miniature beverage bottle adapted to be stored within the secondary compartment. The miniature beverage bottle containing a liquor beverage, the miniature beverage bottle adapted to be removed from the secondary compartment and combined with the liquid beverage in the body to form a mixed alcoholic liquid beverage. In further embodiments the combination container may be a take out food container, or some other kind of beverage container.

The compartment may be recessed into a wall of such a combination container, between the top and bottom of the container, but without extending for the full length of the container.

In some cases there will be a re-sealable cover for such secondary compartment. The cover may be in the form of a partial cuff, typically of thermoplastic material. The cuff to would be, in the case of a bottle, of generally semi-cylindrical shape.

The cuff would be resilient, and could be spread apart to fit over the bottle and would then make a friction fit on the exterior of the bottle.

This would permit the cuff to be moved, for example by rotation, so that the recess could be opened, for access to the secondary product, and the re-closed, by rotation, is as desired.

The cuff could also be slid endwise over the bottle, if desired.

In the case of other containers, for example rectangular shaped containers, of milk, or fruit juice for example the container could be formed with abutments, for example edge flanges, and the cuff could be shaped with gripping channel shaped edges for frictionally gripping the edge flanges of the container.

In order to facilitate assembly of the primary container and the filling of the container, and the assembly of the secondary item in the cavity, on a high speed bottling line, for example, the secondary item is also pre-package in a secondary item package of pre-determined size and shape. The size and shape of the secondary item package will correspond to the size and shape of the cavity in the primary container.

Preferably the secondary item container will have an outer cover which is profiled and contoured so as to replicate the contours of the bottle or container itself. This will facilitate the application of the typical plastic or paper label.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE INVENTION

Figure 1:
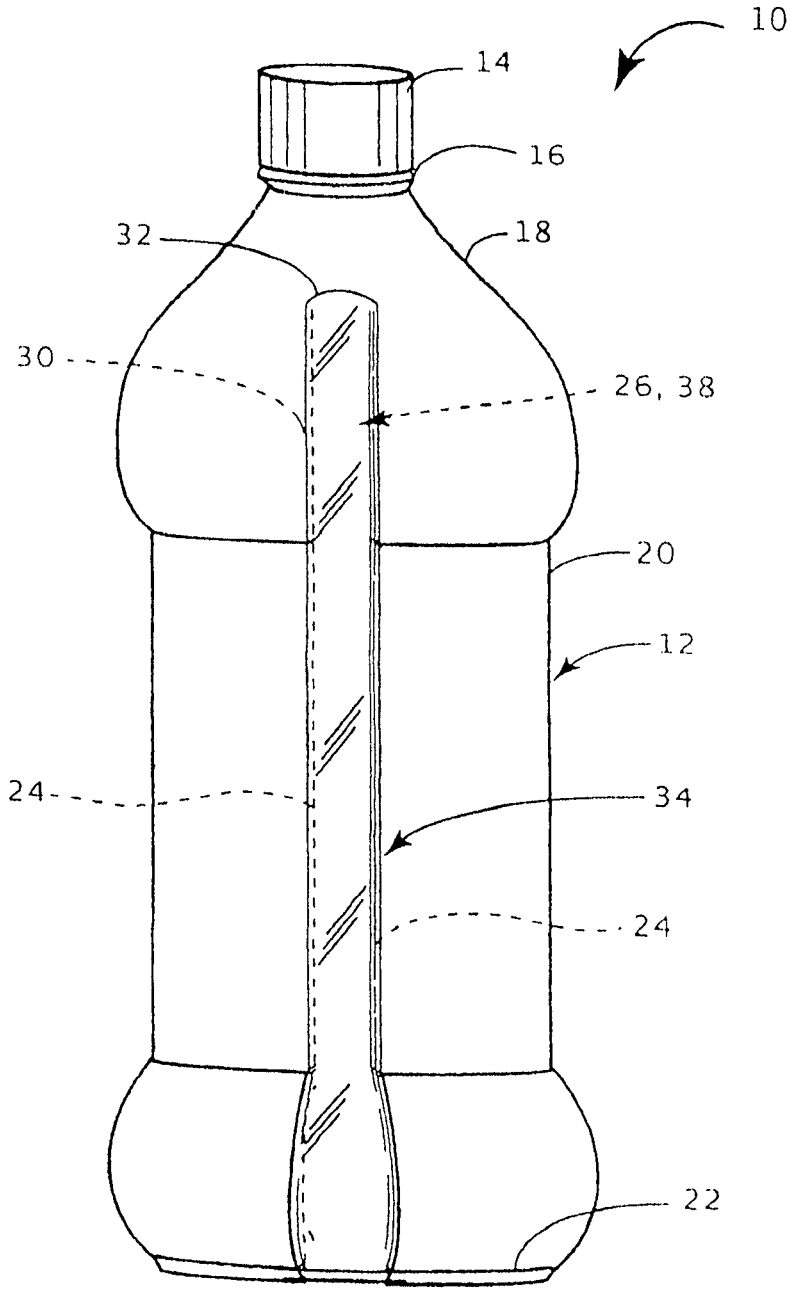
FIG. 1 is a perspective view of a combination container, in this instance a beverage bottle illustrating a secondary compartment for containing one or more secondary products in a preferred embodiment of the present invention.
Figure 2:
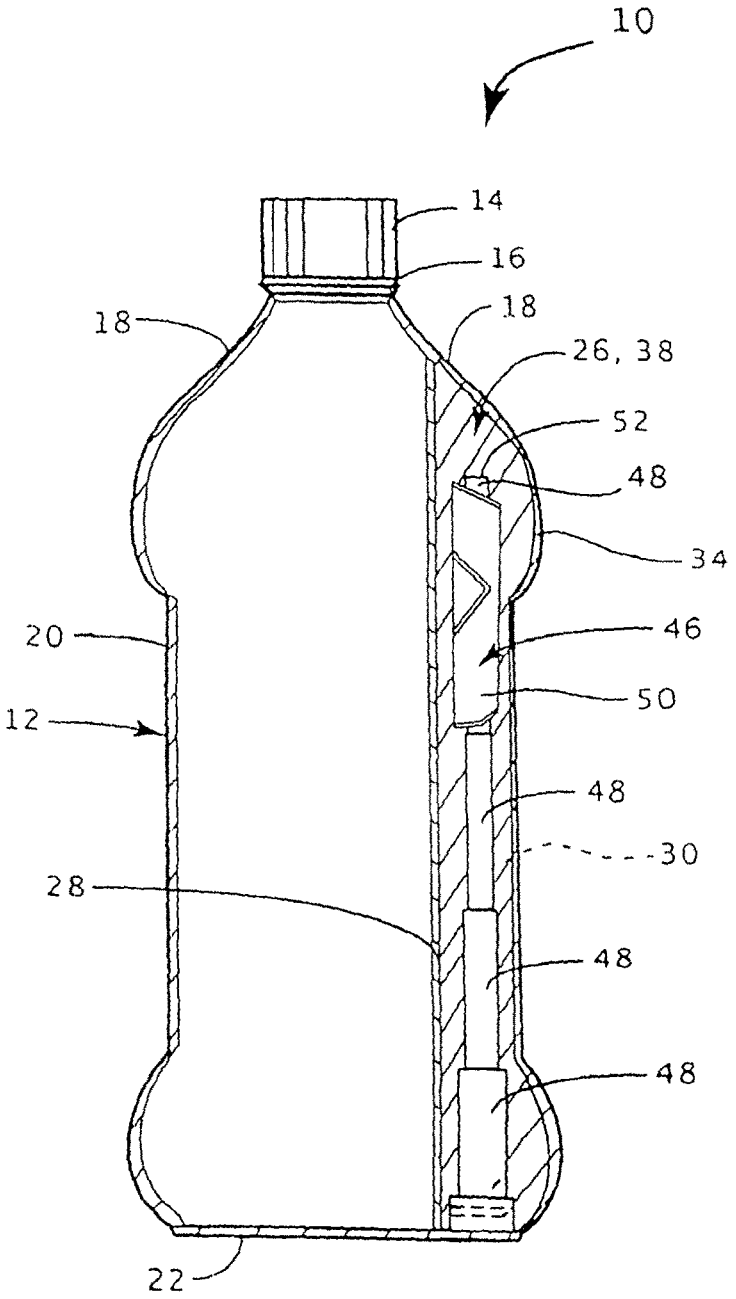
FIG. 2 is front cross-sectional view of the beverage bottle illustrated in FIG. 1 and showing the secondary compartment and the one or more secondary products in accordance with a first embodiment of the present invention.
Figure 3:
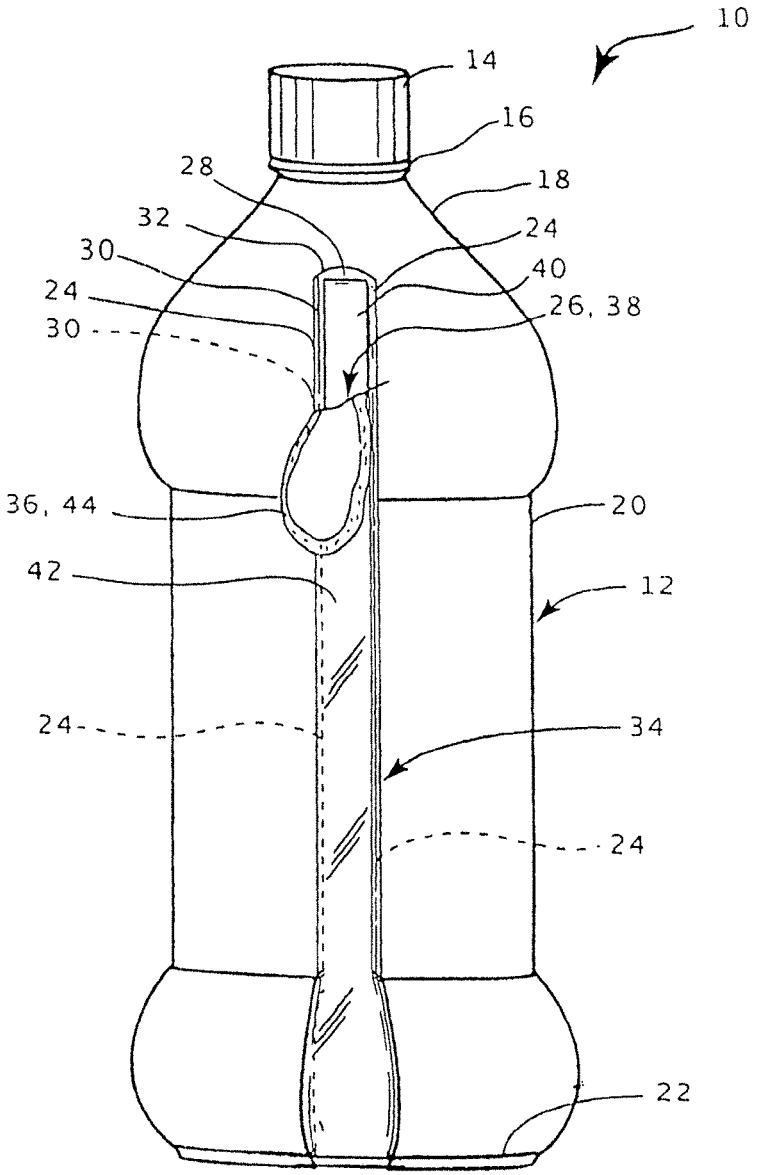
FIG. 3 is a cross-sectional plan view of the beverage bottle along the Section A-A in FIG. 1 and showing the secondary compartment and the one or more secondary products.

Reference is made to FIGS. 1-3 which are given here by way of illustrating the invention and without limitation. These Figures illustrate a combination container, in this example a beverage bottle 10, providing a primary compartment in the interior of the bottle, and constructed with a secondary compartment 12 for containing and storing one or more secondary products 14 in accordance with an embodiment of the present invention.

The beverage bottle 10 has a body 16 for holding a liquid beverage. The body 16 has a lid or cap 18 releasably coupled to a neck 20 which, when removed, enables a user to consume the contents, in this case, to drink or pour the liquid beverage from the beverage bottle 10. The lid or cap 18 may be coupled to the neck 20 using any suitable fastening mechanism, such as a threaded fastening mechanism or a snap-fit fastening mechanism. The neck 20 is formed with a generally sloping shoulder 22 which merges with a cylindrical sidewall 24. The cylindrical sidewall 24 extends to a base 26 which is adapted to support and stabilize the beverage bottle 10 when it is placed on a generally horizontal surface.

Referring to FIGS. 1-3, the base 26 is formed with a centrally located aperture 28. The secondary compartment 12 consists of a generally cylindrical cavity 30 extending into the body 16 of the beverage bottle 10. The cavity 30 is formed with a cavity wall 32 extending vertically from an open end 34 defined by the aperture 28 to a closed end 36 proximate to the neck 20. The cavity wall 32 of the secondary compartment 12 is generally parallel to the sidewall 24 of the body 16. The base 26 of the beverage bottle 10 may be provided with a closure or seal 38 which covers the aperture 28 to prevent tampering with the bottle 10 and to secure the one or more secondary products 14 within the secondary compartment 12. In an embodiment of the present invention, the length X of the cavity 30 is substantially equal to the length Y of the body 16. By this design, the cavity 30 of the secondary compartment 12 is capable of storing one or more secondary products of various lengths. However, it should be understood by a is person skilled in the art of the present invention that the cavity 30 may have any suitable length X and may be adapted to conform to the dimensions of the secondary product 14 to be stored therein.

Referring to FIGS. 2 and 3, the one or more secondary products 14 are designed to be initially stored within the secondary compartment 12 when the beverage bottle 10 is offered and subsequently sold to a user at a sporting or entertainment venue, for example. When the beverage bottle 10 is purchased by the user, the closure or seal 38 may be removed to permit access to the one or more secondary products 14 stored within the secondary compartment 12. Once removed from the secondary compartment 12, the user may then display or otherwise use the one or more secondary products 14 during the course of the sporting or entertainment venue. It should be understood that a wide variety of secondary products 14 may be provided within the secondary compartment 12, including, but not limited to banners, flags, signs, miniature beverage bottles, candy, glow sticks, rally sticks, inflatable balloons, and/or personal hygiene items, or drinking straws or plastic cutlery. In a first embodiment of the present invention shown in FIG. 2, the one or more secondary products 14 may include a banner, flag and/or sign, for example, that are dimensioned to be received within the secondary compartment 12. Referring to FIG. 2, the one or more secondary products 14 consist of a plurality of telescopic members 40 and a banner 42 which may be unfurled and displayed by a user during a sporting or entertainment event. The banner 42 may bear information relating to the liquid beverage, the beverage manufacturer, and/or the participants in the sporting or entertainment event, for example. The banner 42 is secured to at least one of the telescopic members 40 at a first end 44 of the secondary product 14. The seal 38 may be dimensioned to have roughly the same cross-sectional area as the aperture 28 in the base 26 so as to ensure that the secondary product 14 is securely stored within the secondary compartment 12 when not in use.

During assembly, the plurality of telescopic members 40 are press-fit or snap fit into one another to collapse the secondary product 14 into a compact size suitable for insertion into the secondary compartment 12. The banner 42 is furled or rolled up around the collapsed telescopic members 40 to facilitate the manual insertion of the secondary product 14 into the secondary compartment 12 of the beverage bottle 10. The seal 38 may then be at least partially inserted into the aperture 28 in the base 26 to secure the secondary product 14 within the secondary compartment 12.

When the seal 38 is removed, the banner may be removed by the consumer grasping the end of the telescopic member and then withdrawing the secondary product.

To facilitate the removal of the secondary product 14 from within the secondary compartment 12, an optional spring biasing mechanism 48 having a spring member 50 may be provided within the closed end 36 of the secondary compartment 12 for urging the secondary product 14 towards the open end 34 of the secondary compartment 12. By this design, when the seal 38 is manually removed, the secondary product 14 is at least partially urged from the open end 34 of the secondary compartment 12 by the spring member 50 of the spring biasing mechanism 48.

Following the display of the secondary product 14, the user may collapse the telescopic members 40 and snugly furl the banner 42 around the one or more telescopic members 40. The secondary product 14 may then be reinserted into the secondary compartment 12 and secured by the seal 38 for secondary purposes.

Figure 4:
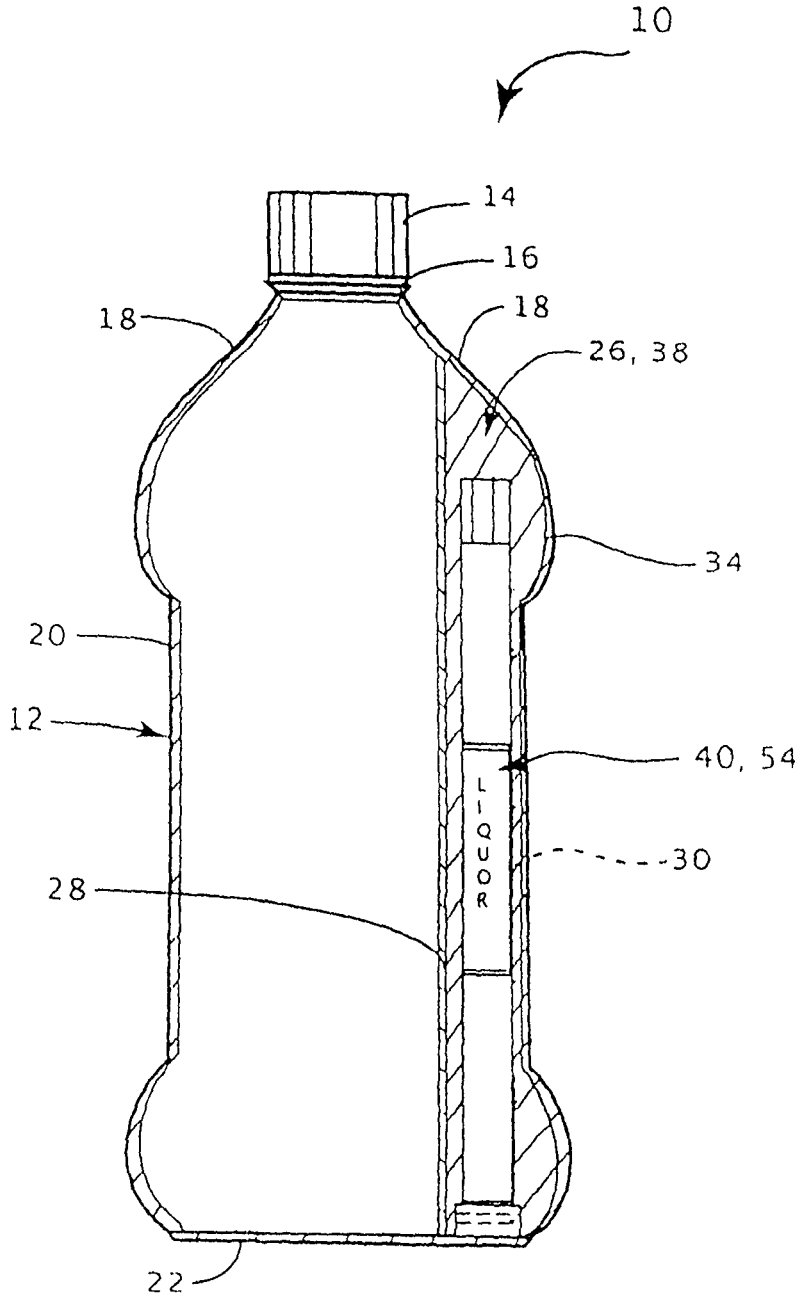
FIG. 4 is a front cross-section view of the beverage bottle illustrated in FIG. 1 and showing the secondary compartment containing a miniature beverage bottle in accordance with a second embodiment of the present invention.

In a second embodiment of the present invention shown in FIG. 4, the one or more secondary products 14 are one or more miniature beverage bottles 52 containing samples of new secondary beverages offered by a beverage manufacturer. By this design, manufacturers may provide existing consumers with samples of new secondary beverages together with the liquid beverages in the beverage bottles 10. It is contemplated that the one or more miniature beverage bottles 52 may contain a wide variety of beverages, including liquor, water and carbonated water, flavored syrup and flavored crystals. In the example of a liquor-filled miniature beverage bottle, the user may remove the seal 38 and pour the liquor contents of the one or more miniature beverage bottles 52 into the body 16 of the beverage bottle 10 to create a mixed alcoholic beverage. It should be understood by a person skilled in the art of the present invention that a wide variety of liquor beverages may be contained within the one or more miniature beverage bottles 52, including vodka, rum, whiskey and/or rye. It should be further understood that the variety of liquor contained within the one or more miniature beverage bottles 52 may be selected by the beverage manufacturer to complement the liquid beverage contained within the beverage bottle 10.

Figure 5:
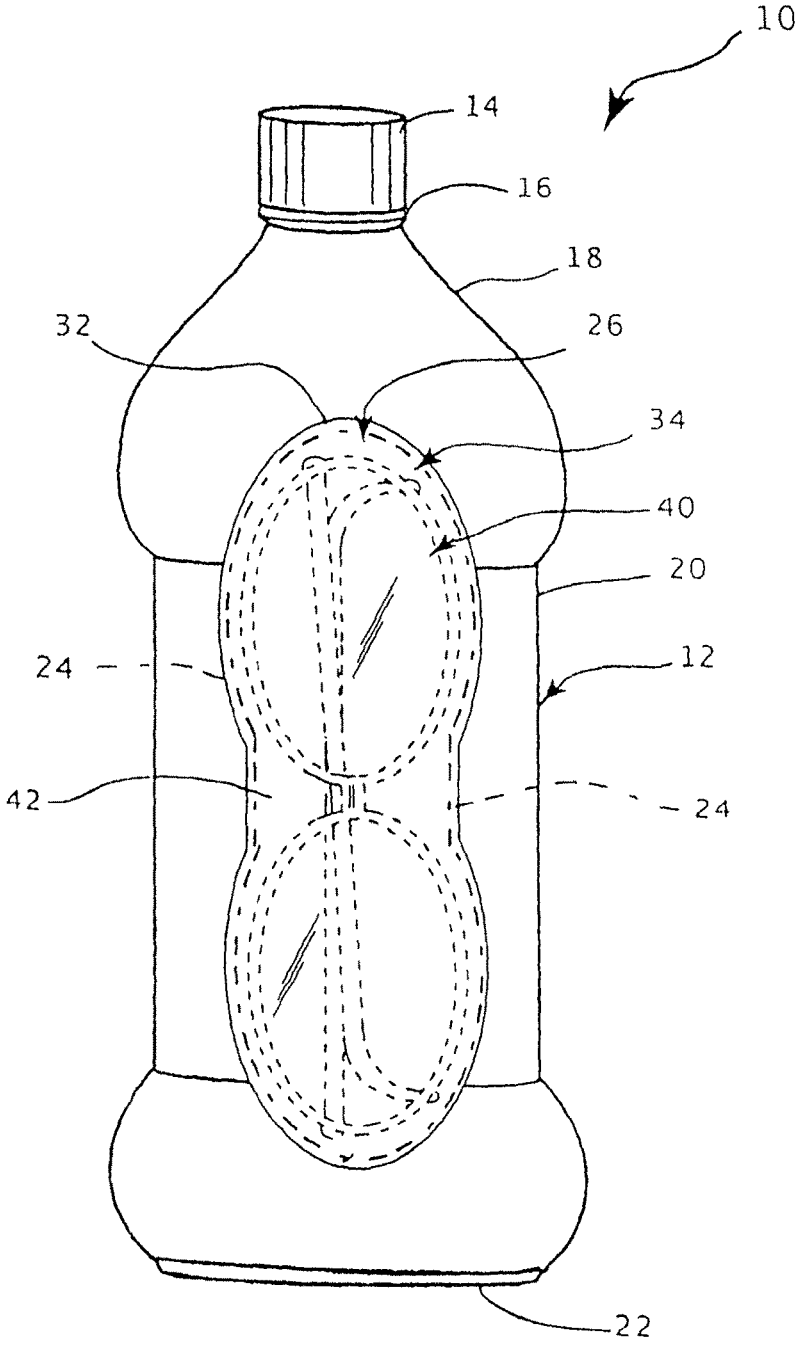
FIG. 5 is a front elevation of a beverage bottle showing a secondary product in phantom in the secondary compartment and secured in position by a closure panel, in accordance with the third embodiment of the present invention.
Figure 6:
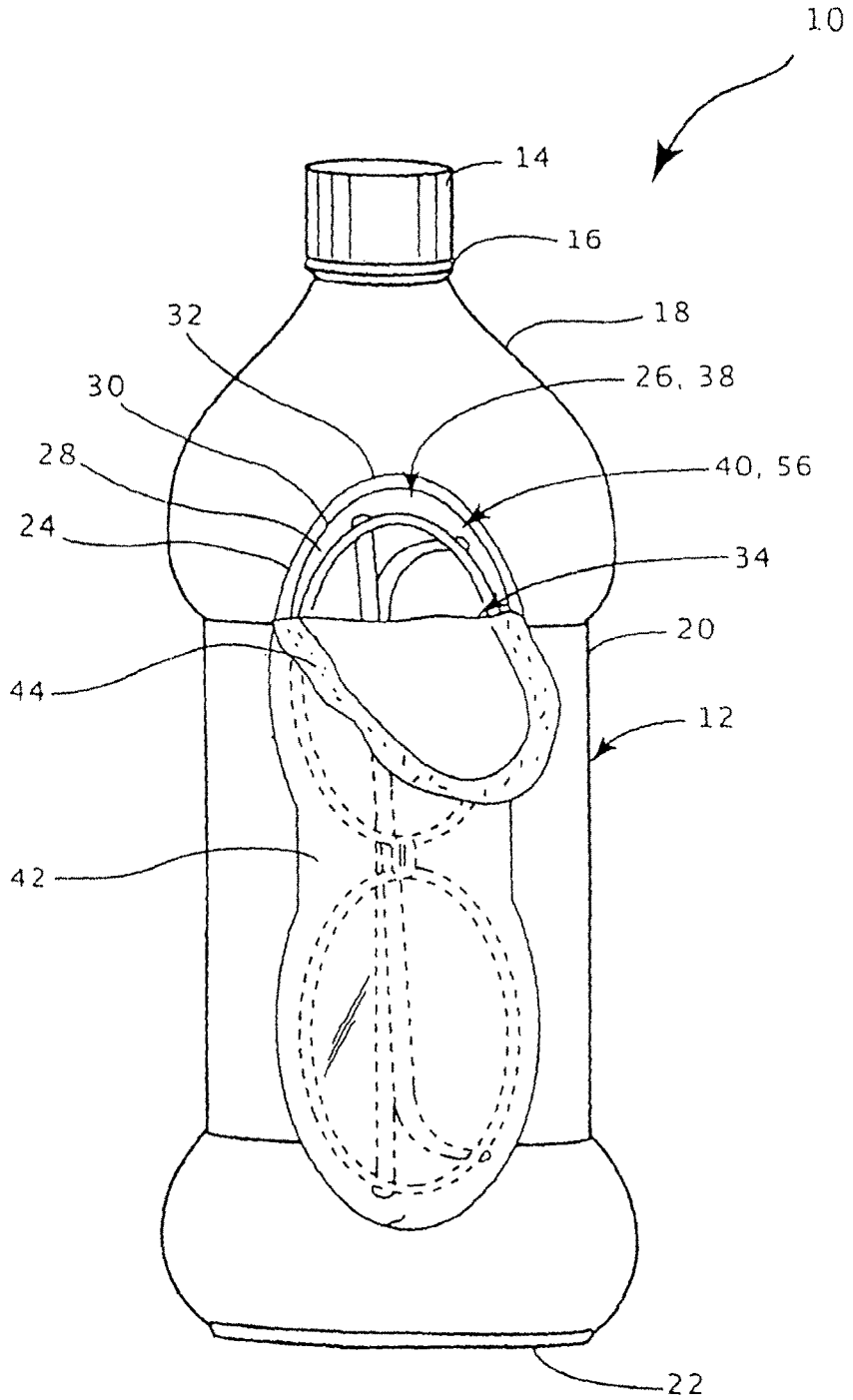
FIG. 6 is a front elevation corresponding to FIG. 5 showing the closure panel partly peeled away to reveal the secondary product.

In a third embodiment of the present invention shown in FIG. 5, the compartment may be of a more contoured shape, possibly designed to accept the shape of a particular specialized secondary product such and spectacles and may not necessarily extend the full length of the container or bottle. The closure panel 42 extends the full length of the compartment. As shown in FIG. 6 the closure may be peeled back to remove the secondary item.

Figure 7:
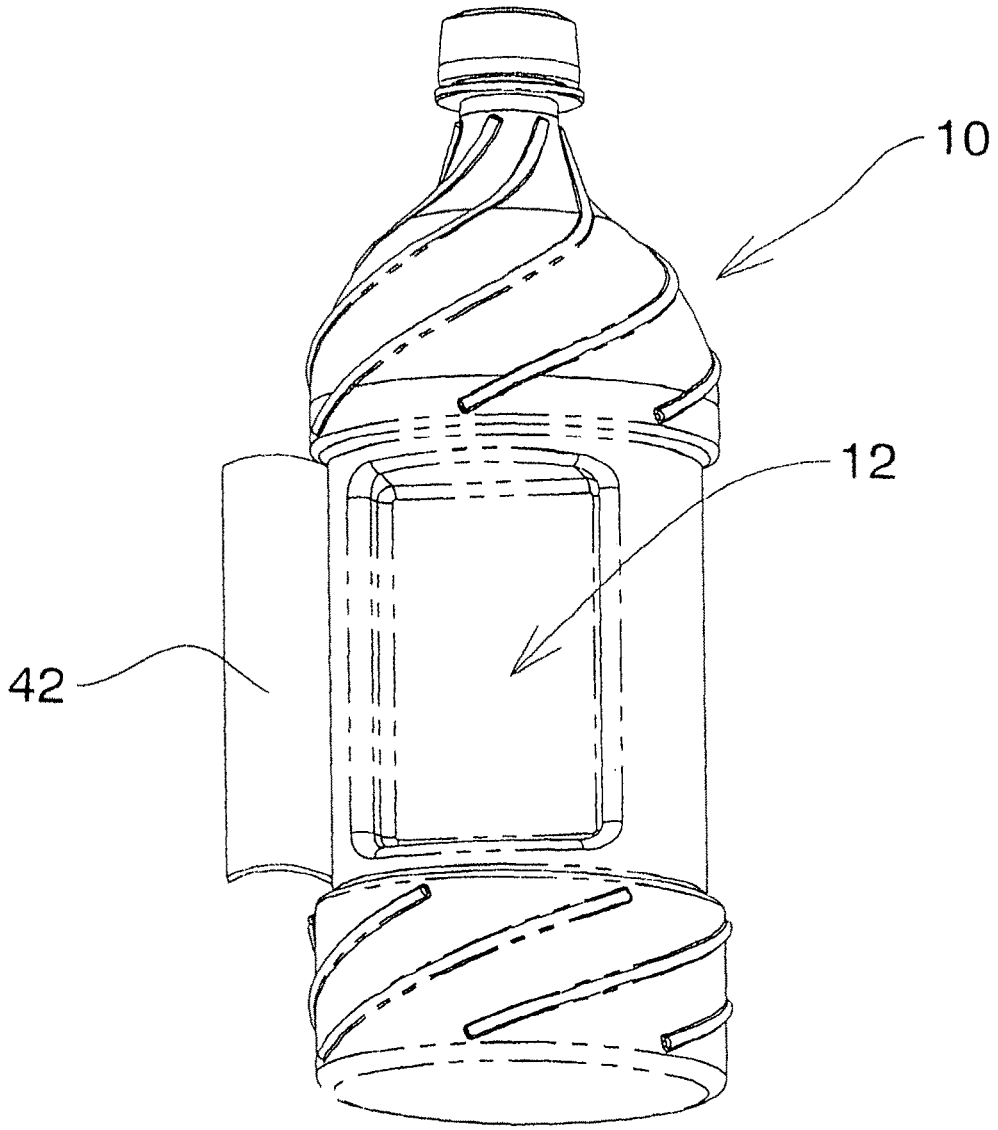
FIG. 7 is a perspective of a further embodiment, showing the closure partly peeled away from the compartment.

FIG. 7 shows a further modification, for use with a container such as a beverage bottle 10.

In this case the compartment 12 is of generally rectangular shape. Such a shape may hold a snack bar, or candy. It might be used to contain hand wipes. The closure 42 is dimensioned to cover up the compartment 12. The closure may possibly be part of the label applied to the bottle. It has a resealable adhesive around the edges so that it may be opened up, and then rewrapped around the bottle 10.

Figure 8:
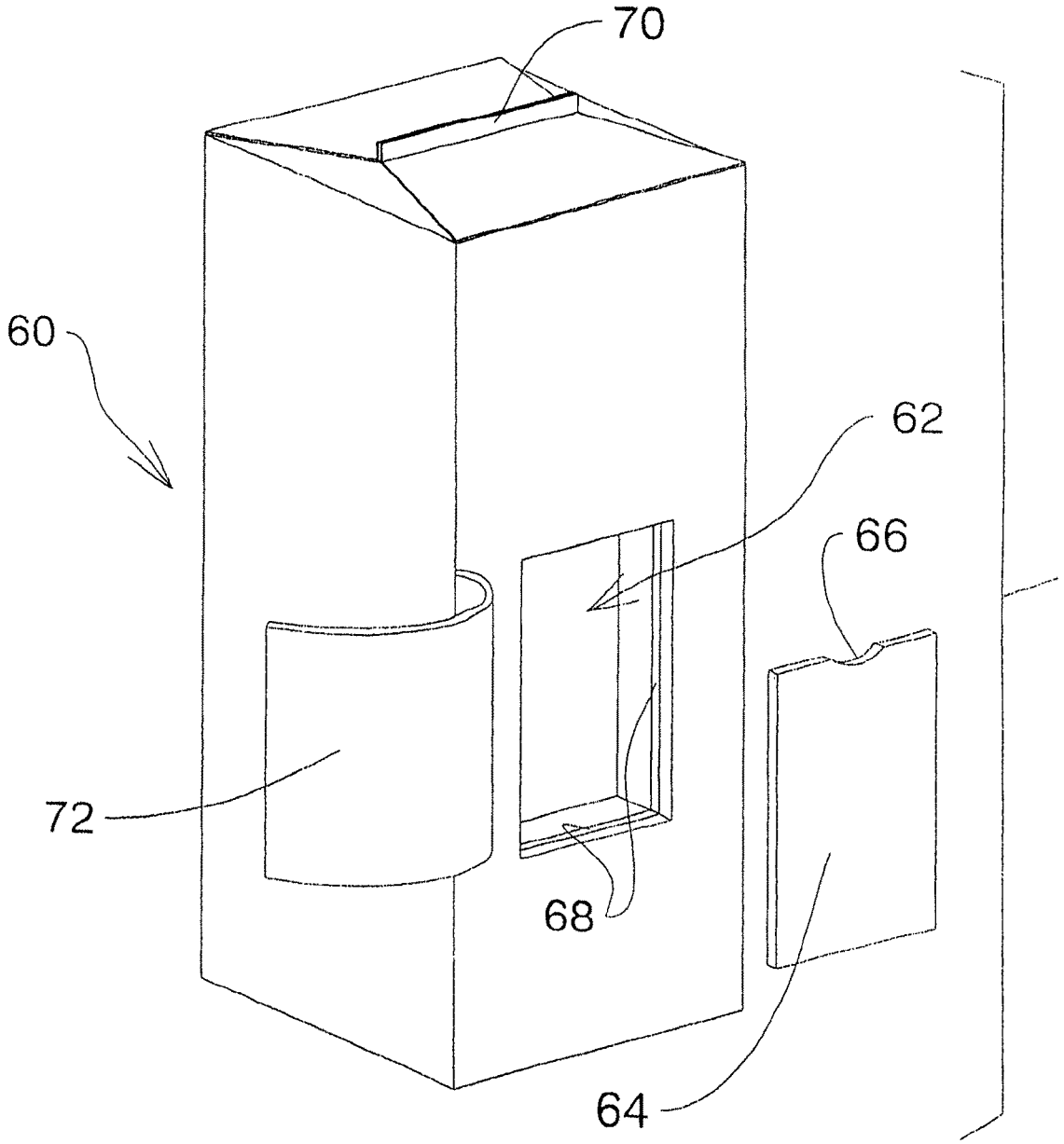
FIG. 8 is an exploded perspective of another embodiment, for an angular section carton, showing a compartment and closure panel.

FIG. 8 shows a rectangular shaped container 60. Typically such containers are made of paper, coated in any suitable coating, and such containers are typically used for non carbonated drinks, such as milk, juice and even water The container 60 has a secondary compartment 62, in this case of rectangular shape.

A closure panel 64 of rectangular shape may be bonded into compartment 62 of container 60, to retain a secondary product within the compartment 62.

A cut out portion 66 may be provided at an edge, so as to permit the opening of the is panel 64 for access to the compartment 62.

Compartment 62 may be formed with an interior ridge 68 to retain the panel 64 in position, and provide the entire container 60 with a smooth exterior shape, for shipping and handling.

The container 60 typically has, in this example, a sealed top 70 which can be opened up to dispense the contents.

In most cases there would be a label 72, with adhesive backing. This would be applied over the closure panel 64, and assist in holding it in place.

Figures 9, 10:
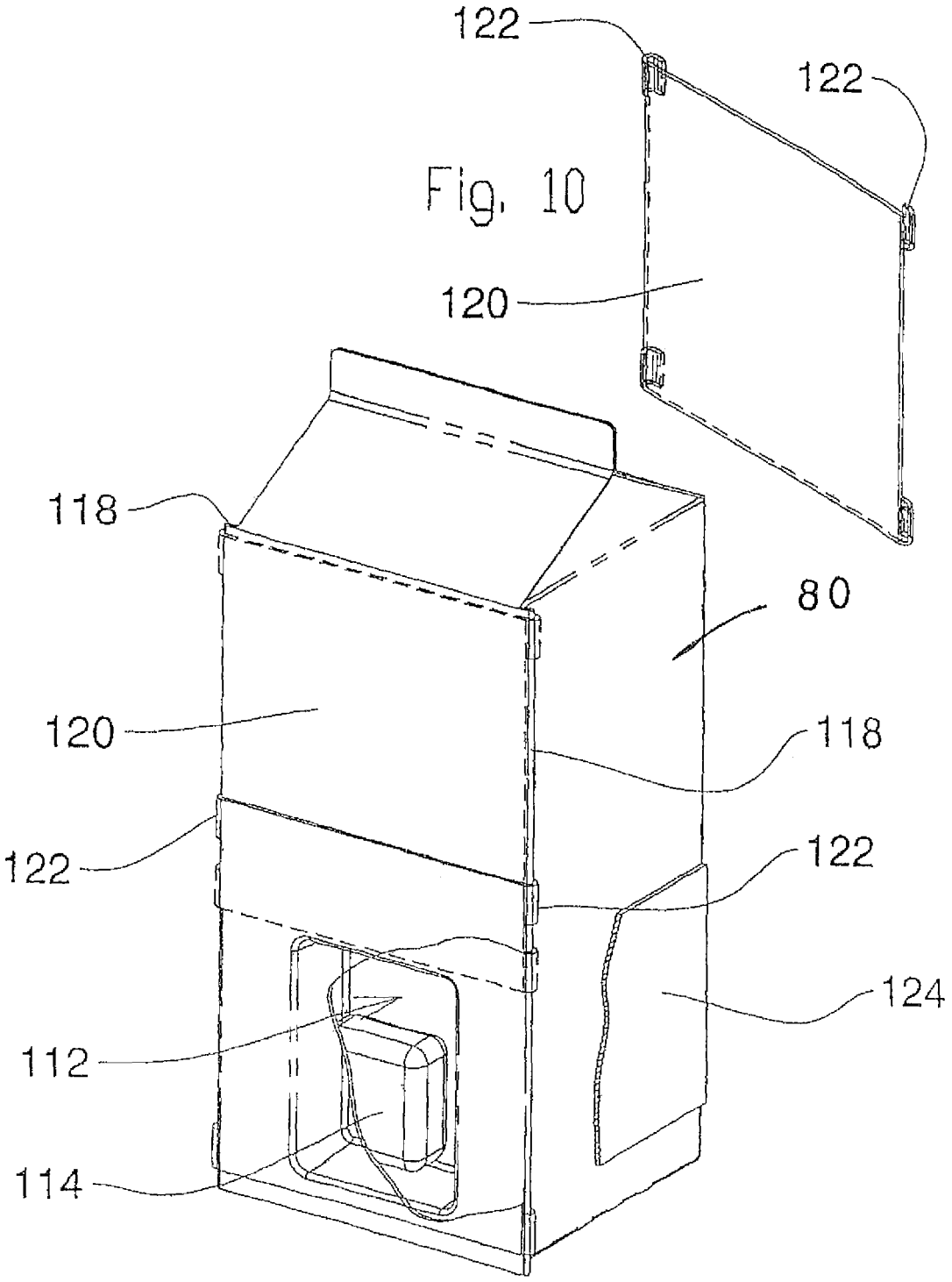
FIG. 9 is a cut away perspective view of an alternate embodiment for an angular section carton.
FIG. 10 is a perspective of the closure panel of FIG. 9.

FIGS. 9 and 10 show another embodiment of angular container 80. In this case the container is formed with a recess 112. Along the sides of the container edge flanges 118 are formed.

The recess 112, in this case is covered by a cover 120. Cover 120 has channel shaped edge grippers 122. The edge grippers fit over the edge flanges. The cover is thus slidable up and down. This enables a purchaser to retrieve the item 114 in the recess, or to replace it and close the cover.

For purposes of facilitating assembly the item 114 may have an adhesive patch (not shown) thereon. The adhesive is a contact adhesive of the type which provides only a simple gripping action, so that the item is readily separable without damage.

When the item is placed in the recess, the adhesive patch on the item will hold the item in the recess, and enable the cover to be moved into position.

Figure 11:
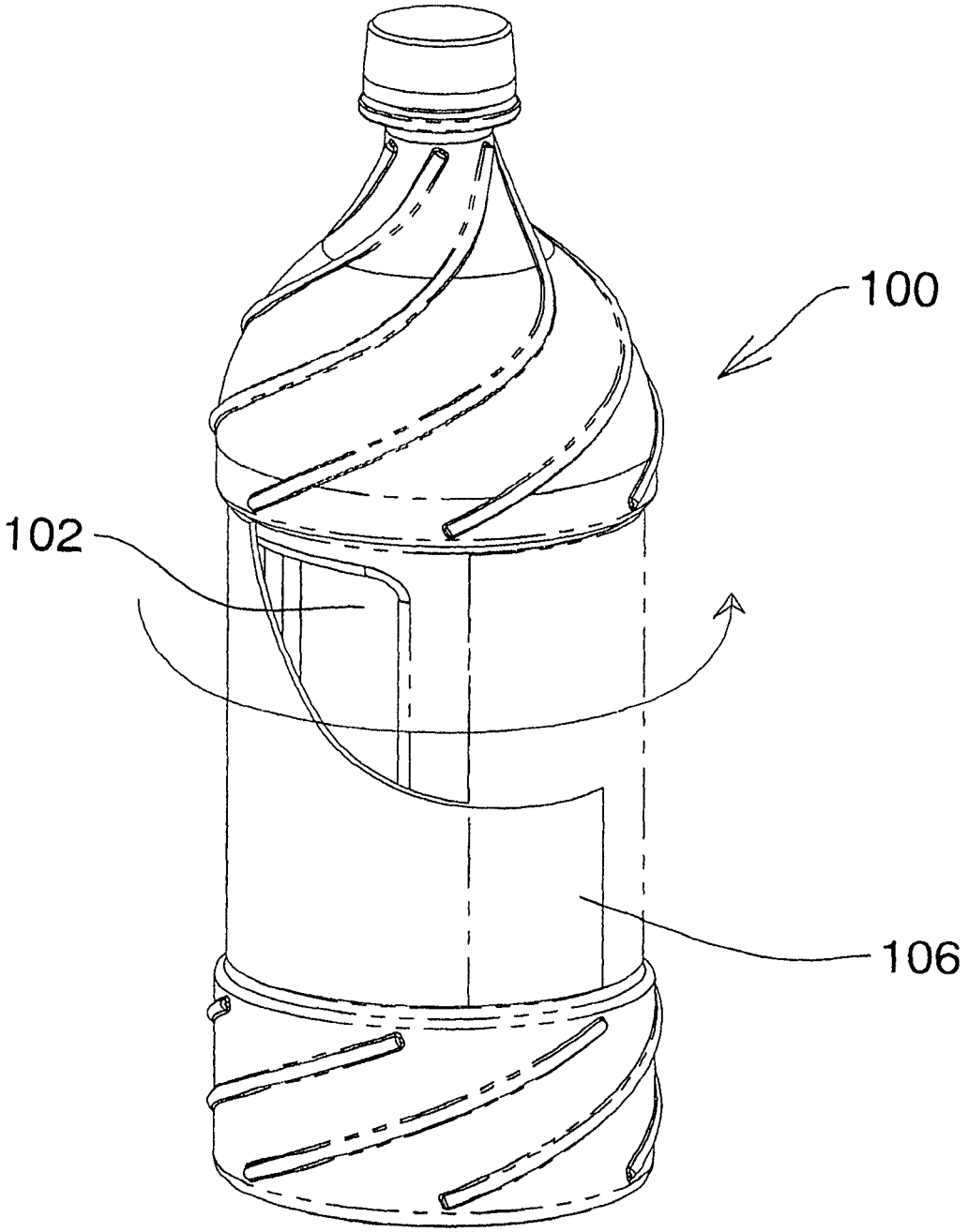
FIG. 11 is a perspective view of a bottle container, illustrating a slidable and flexible cuff cover for covering the secondary item recess.
Figure 12:
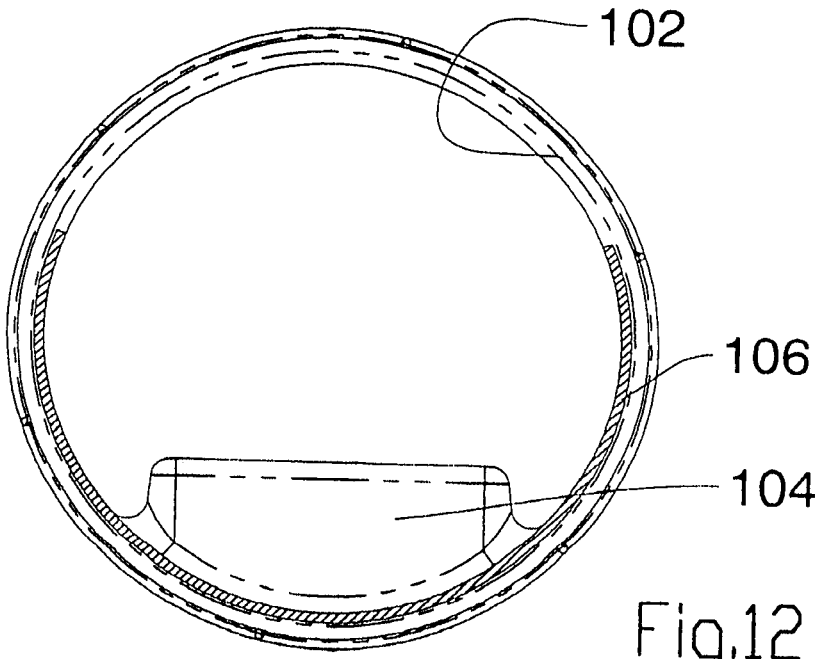
FIG. 12 is a section along line 12-12 of FIG. 11.

A further embodiment of the bottle is shown in FIGS. 11 and 12.

In this case the bottle 100, has an exterior opening recess 102, formed as a depression in the bottle side wall.

A secondary item 104 may be deposited in recess 102; for removal later by the purchaser. A dab of temporary adhesive may secure the item in the recess.

The recess 102 may be closed off by a sliding resilient cover 106.

Cover 106 is of generally semi cylindrical contour in section (FIG. 11), which has essentially the same radius as the radius of the central portion of the bottle, in the region of the recess 102.

Cover 106 makes a friction fit around the exterior of bottle 100. It is resilient and can be sprung open (FIG. 12) to snap fit over the contour of the bottle, and will then spring closed, when released.

Typically a label of paper or plastic film (not shown) will be applied over the cover 106, and hold it in position prior to sale.

The purchaser can tear open the label, and release the cover 106. The cover 106 can then be rotated (FIG. 10) or completely removed, if desired., for access to the recess 102.

Figure 13:
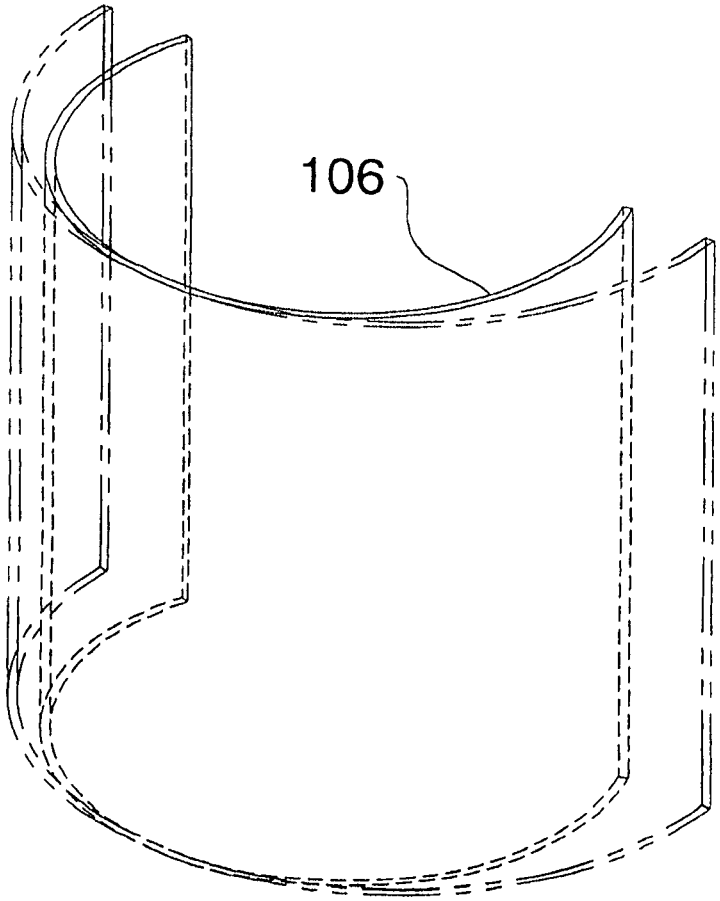
FIG. 13 is an exploded view of a cuff, of FIG. 12 showing flexing movement in phantom.

A further embodiment is shown in FIG. 13.

In this case the container 110, is of angular shape, in this case rectangular in cross section, such as is typical in milk cartons or juices containers, for example.

In this case an exterior recess 112 is formed in a side wall of the container 110.

A secondary item 114 is shown nested in the recess 112. the secondary item is provided with a temporary dab of adhesive surface film 116. The film 116 is of the type of adhesive which provides only a relatively weak bond. It is just sufficient to hold the item in the recess, so as to enable the remaining packaging steps to be completed, without the item falling out of the recess.

Edge flanges 118 are formed along each side edge of the one side wall of the container 110 (FIG. 13). Flanges 118 project outwardly from the container.

A cover panel 120 is formed with side channels 122 down each side edge.

The channels 122 receive the flanges 118, and thus the panel 120 is secured to the container, and covers the recess 112.

If desired a label 124 may be applied to the container to secure the cover in position prior to sale.

When used in the foregoing manner, containers of the present invention, which may or may not be the beverage bottle illustrated, may be offered and sold by businesses to enable users, such as spectators, to utilize the one or more secondary products. In some cases these secondary products may enable a spectator to actively participate in the sporting or entertainment event, for example.

The combination containers may also have a simple utilitarian purpose, so as to facilitate the serving of customers in a fast food establishment, or at an outdoor picnic, or in emergency aid situations.

The combination container, such as a beverage bottle may also be utilized as a business-to-business advertising aid, enabling a liquid beverages business to cross-promote the goods and services of another business by providing advertisements and product samples, for example, within the secondary compartment of the beverage bottle. In addition to the the various secondary and advertising opportunities that may be pursued using the beverage bottle of the present invention, the beverage bottle may is continue to be utilized by a user in a conventional manner to quench their thirst and thereby further enhance their enjoyment of the related business, sporting or entertainment event.

It will be understood that there are to be no limitations as to the dimensions and shape of the beverage bottle 10, including the secondary compartment 12 and the one or more secondary products 14 stored therein, or the materials from which the beverage bottle 10 is manufactured. The beverage bottle 10 may be constructed to resemble any commercially available bottle for holding a liquid beverage and may be manufactured from any suitable plastic, glass, or metal. An example of a suitable plastic material is polyethylene terephthalate (PET) material. Furthermore, it should be understood that the combination container of the present invention may be adapted to store and serve any suitable liquid, such as, for example, water, juice, milk, carbonated sodas, beer and liquor.

The assembly of a package consisting of the primary container and the secondary product may proceed as follows.

The container is first filled with liquid (in this embodiment), and the top sealed.

Figure 14A:
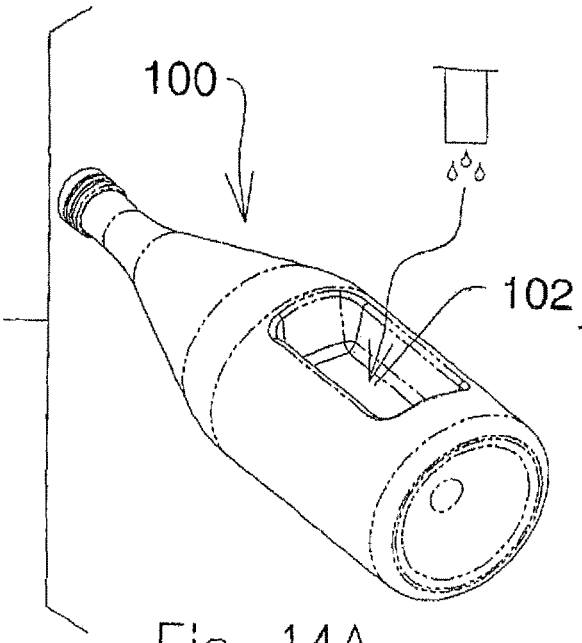
FIGS. 14*a, b* and *c* are schematic illustrations showing the sequence of steps involved in assembling the package with the secondary product.

The container is then moved with its secondary compartment uppermost, to a bonding station as in FIG. 14*a*.

An adhesive compound is then applied to the back wall of the cavity, by an applicator. The adhesive will be a contact adhesive, with only moderate bonding strength. For example a compound as simple as low strength rubber cement could be used.

Figure 14B:
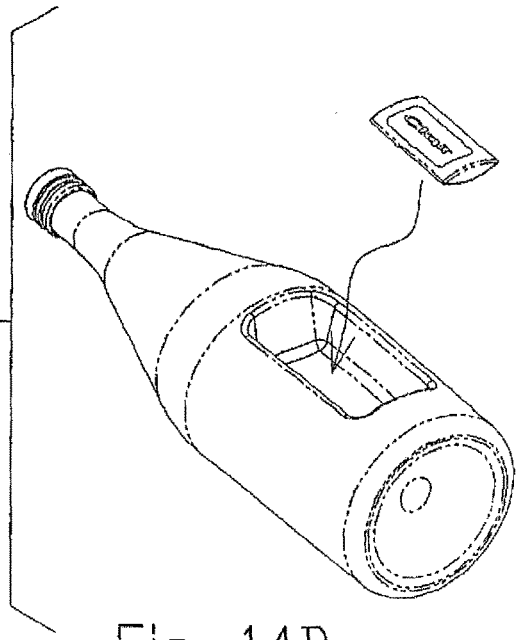

The container is then passed to a second step as in FIG. 14*b*. In this step the secondary product is placed into the cavity. It will contact the adhesive and become temporarily held in position, at least sufficient to resist accidental dislodgment.

Figure 14C:
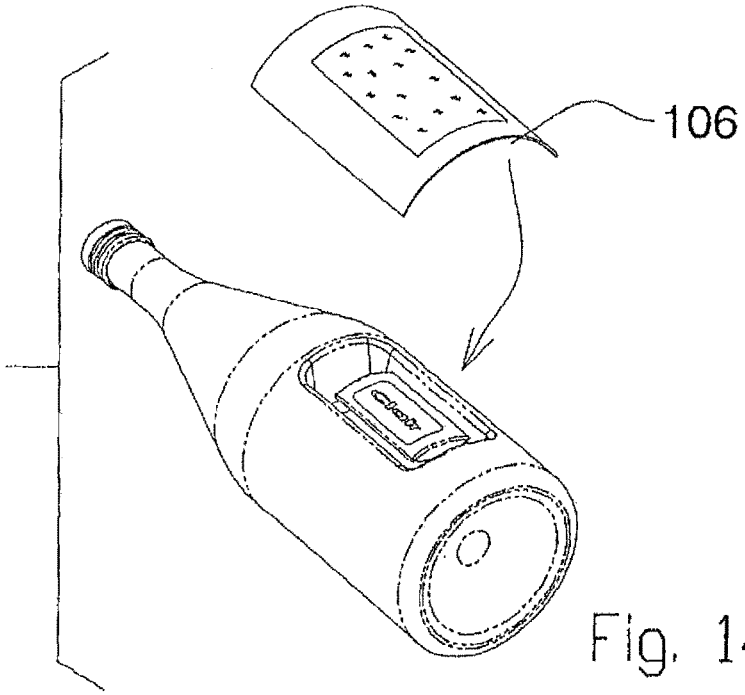

At a third step as in FIG. 14*c* the closure is applied over the cavity and the secondary product.

Figure 15:
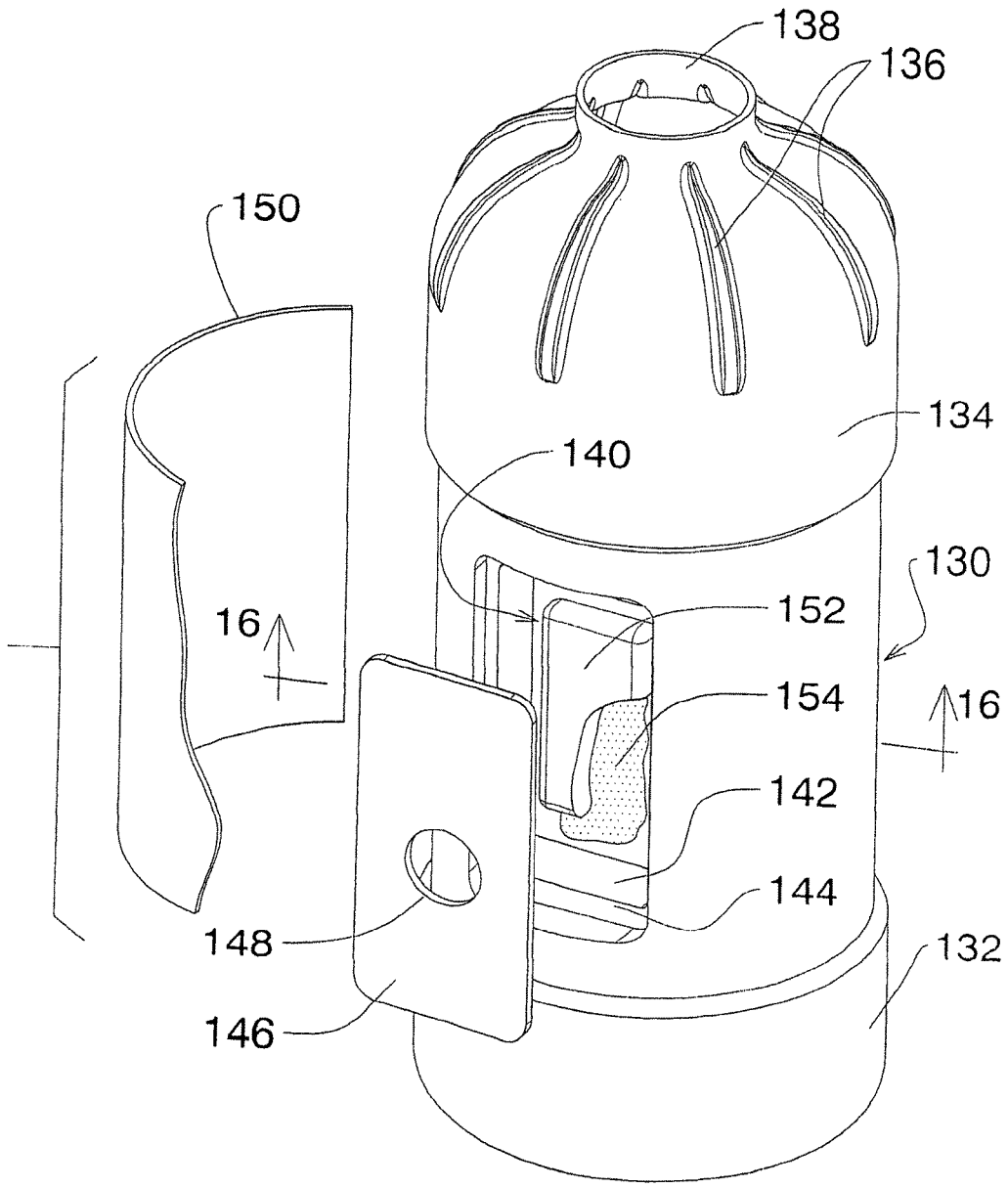
FIG. 15 is an exploded perspective illustration of a bottle, showing the recess, secondary item, adhesive, and cover panel.
Figure 16:
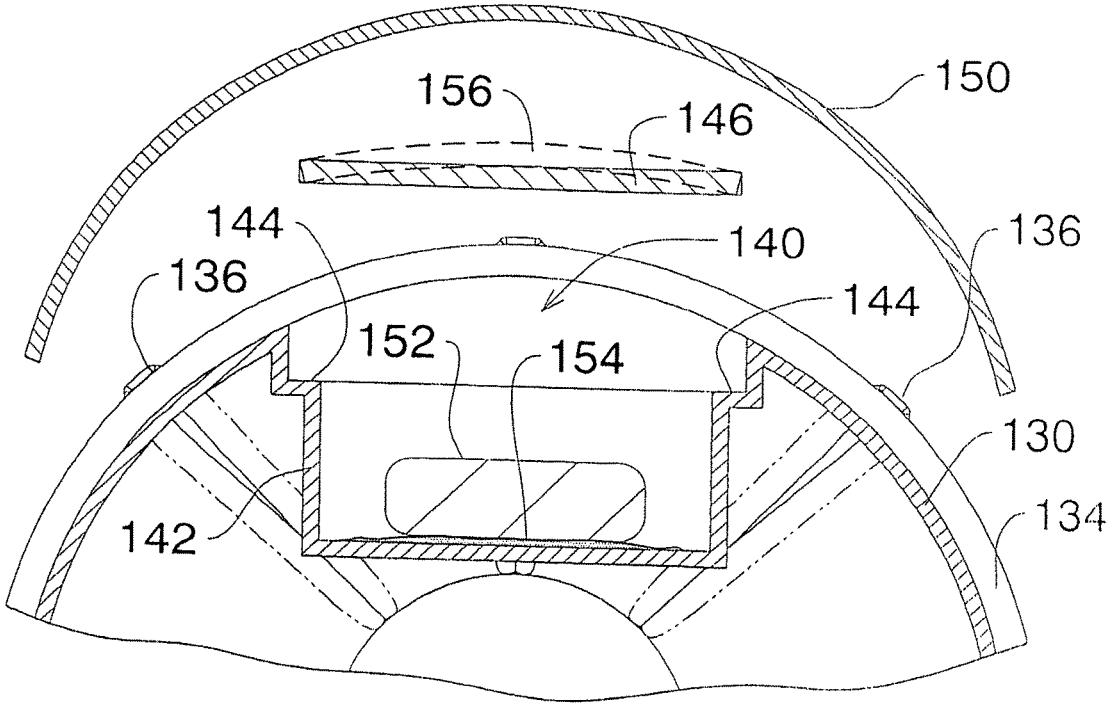
FIG. 16 is a section along the line of 16-16 of FIG. 15.

A further embodiment is shown in FIGS. 15 and 16. In this case, FIG. 15 illustrates is a bottle 130, of a typical generally cylindrical shape having enlarged lower and upper formations 132 and 134, and reinforcing ribs 136, leading to a neck 138. The neck 138 is shown cut away but would of course extend upwardly and provide an attachment for a suitable bottle cap (not shown). Within the cylindrical side wall of the bottle 130, a depression or cavity 140 is formed. The depression 140 is of generally rectangular shape in this example defining four side walls 142 indented inwardly into the interior of the bottle. The side walls 142 are formed with a ledge 144 extending inwardly around the four side walls 142 of the depression 140.

A semi-rigid cover panel 146 is shown. The panel 146 is dimensioned to fit within the open mouth of the depression 140 but lies on the ledge 144 extending around the side walls 142, thereby covering the secondary item. Panel 146 conforms to and complements the contour of the bottle 130 itself.

Preferably, for ease of manipulation, the panel 146 is formed with a finger opening 148. This will facilitate the removal of the panel by a consumer.

A label 150 is shown in part. It will be seen that it will wrap around the bottle, and completely cover the depression 140 and panel 146.

Within the interior of the depression 140, a secondary item 152 is shown, secured temporarily by a relatively weak form of temporary adhesive 154, (described above).

Once the cover panel 146 has been inserted and is lying against the ledge 144, the label 150 is then wrapped around the entire bottle and covers the cover panel. The cover panel being of semi-rigid material will function to retain the item 152 and to support the label in the region of the depression, and thus ensure that the bottle and label arrives at the point of sale intact and having a good marketable appearance.

The cover panel may be formed simply of card stock. Alternatively it may be made of some thermoplastic material, which may be curved as at 156 (in phantom) to conform to the profile of the bottle.

For the sake of convenience and facilitating high speed handling on an automated packaging line, some form of contact adhesive may be applied to the ledges 144. This will have the effect of retaining the cover panel 146 in position, as the containers move on down the production line for the application of labels.

Figure 17:
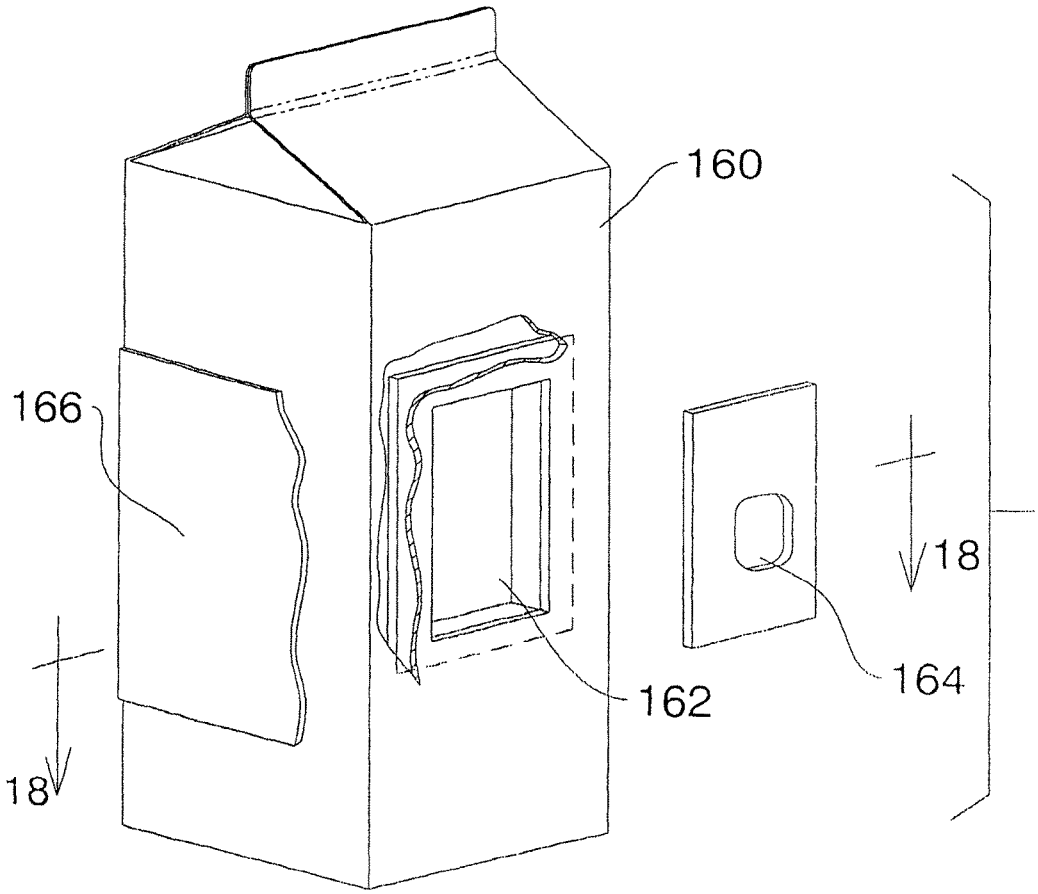
FIG. 17 is a perspective of the FIG. 15 embodiment as applied to a rectangular container.

FIG. 17 shows a rectangular carton 160, typically of coated paper or card. It has a depression 162, similar to 140, for a secondary item 152 and adhesive 154. A cover panel 164 covers depression 162, resting on ledges 166 similar to 144, and enclosed by a label 168.

Figure 18:
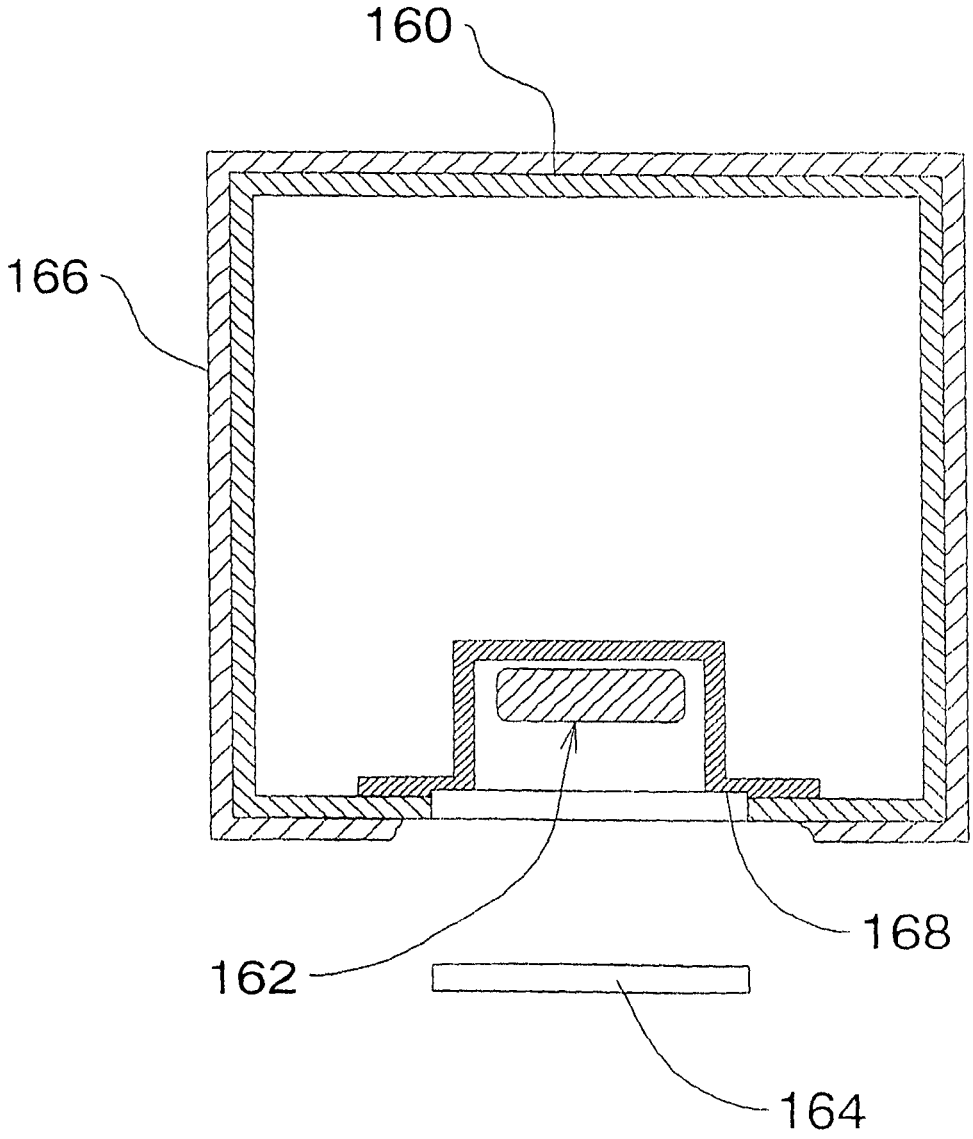
FIG. 18 is a section along the line 18-18 of FIG. 17.
Figure 20:
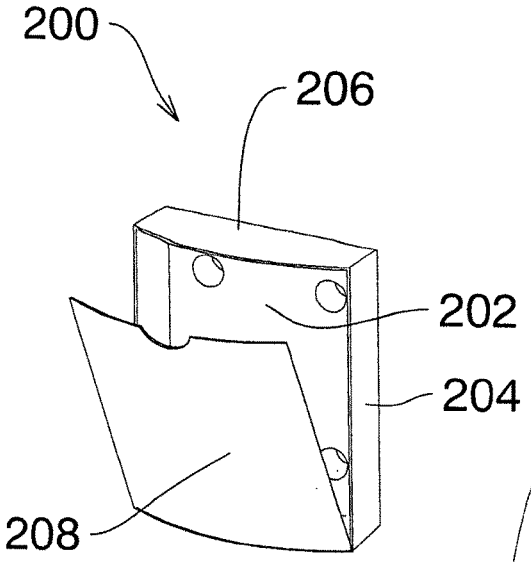
FIG. 20 is a perspective detail illustration of the secondary item package.
Figure 19:
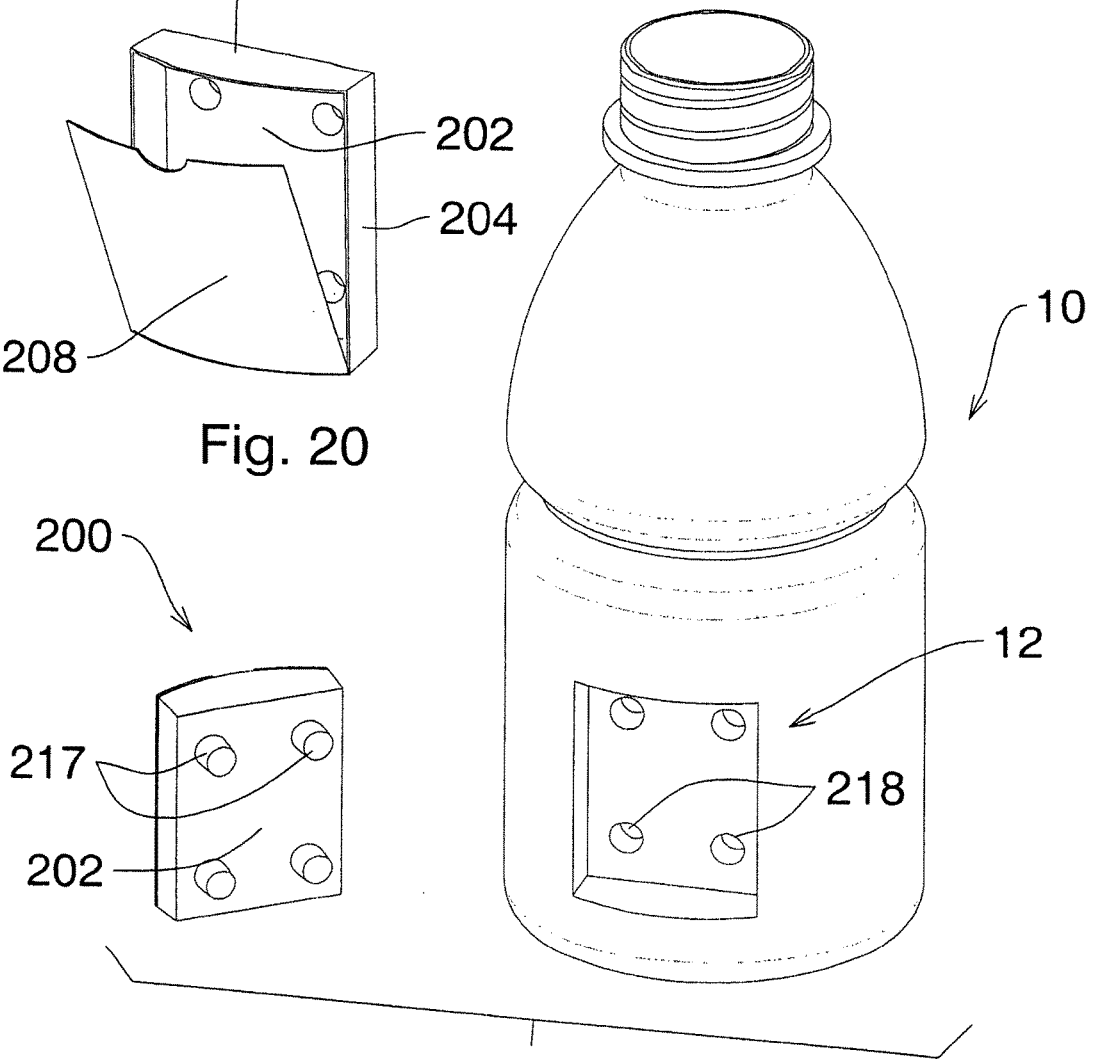
FIG. 19 is an exploded illustration of a further embodiment, showing a secondary item package for fitting in the secondary item compartment.
Figure 21:
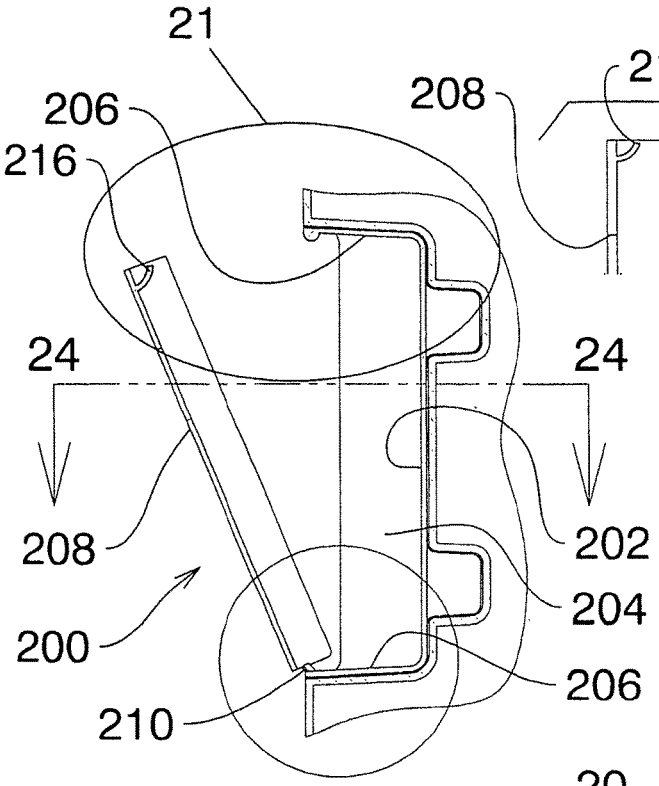
FIG. 21 is a side section of FIG. 20.
Figure 23:
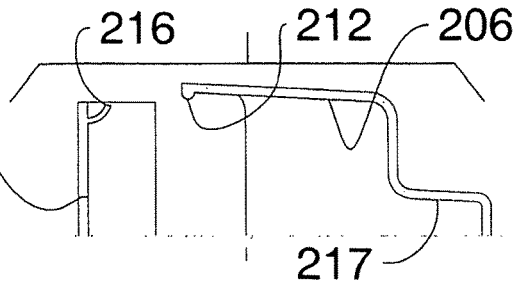
FIG. 23 is an enlarged section corresponding to FIG. 21 showing more detail.
Figure 22:
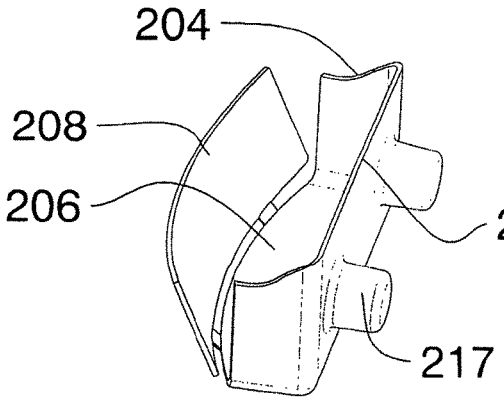
FIG. 22 is a cut away of FIG. 21.
Figure 24:
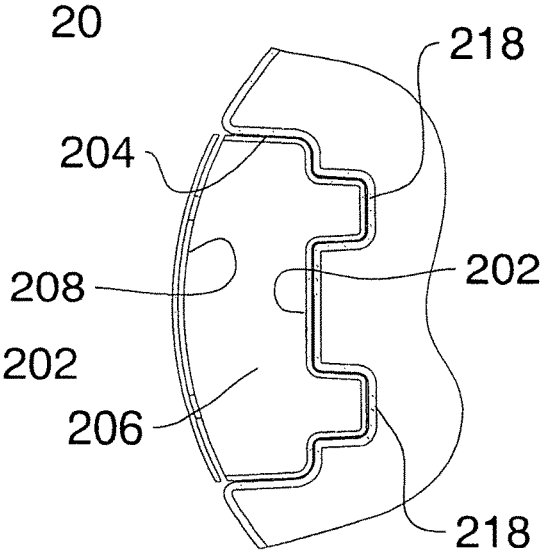
FIG. 24 is a section along the line 24 of FIG. 21.

As shown in FIG. 18, the depression 162 will preferably be formed separately from the carton 160. In the majority of cases, it will be convenient to form the depression 162 from a thermo-plastic material, typically for example, by vacuum forming, or the like.

The depression 162 is formed with side walls 170, formed to define ledges 166. Around the edges of the side walls, generally planar side flanges 172 are formed. During the manufacture of the rectangular carton 160, the carton 160 will be formed with a rectangular opening. The depression 162 will be bonded to the interior of the carton 160, in registration with such opening. The side flanges 172 provide a secure seal with the interior of carton 160.

Further embodiments of the invention are shown in FIGS. 19 through 24.

It is understood that in the particular case of bottling or packaging of consumer liquids, such as sodas, milk and even alcoholic beverages, the production line is moving at high speed and the primary containers are continuously moving. In this environment, the packaging of the secondary item in a depression formed in the primary container presents a challenge.

In order to deal with this problem, the secondary items will themselves be pre-packaged in secondary item packaging illustrated generally as 200. The package will be sized and shaped so as to fit readily within the primary container recess. The secondary item package 200 will have sufficient volume to receive the secondary item whether it be a promotional item or a hand wipe, or a snack. Inside the secondary item package, in general, it will not be necessary to secure the secondary item in any particular position.

It will usually be sufficient that the secondary promotional item is contained within the package so that the assembling of the secondary item package with the primary container can take place in the high speed production packaging line of the primary product and primary container. All that will be required will be to install an additional robot (not shown) such as is well known in the art, to repeatedly pick up a secondary item package and insert it into the secondary item compartment in the primary package.

For this reason, the secondary item package 200, is represented as being of generally rectangular shape, having a back wall 202, and side walls 204, and top and bottom end walls 206. A front closure panel 208 is provided which in the first embodiment is hinged along its lower edge by two spaced apart self molded hinges 210.

It is assumed from the present explanation, that the secondary item package is intended for installation in the bottle having a generally cylindrical side wall. In order to accommodate this, the secondary item package front panel 208 has a curve of generally semi-cylindrical profile, which is intended to simulate the curve profile of the bottle. In order to hold the cover panel 208 closed during assembly in the packaging line, lock members 212 are formed.

Catch strips 216 are formed on closure panel 208.

During the pre-packaging of the secondary item, the closure panel 208 will be swung closed and the catch strips 216 will then make frictional engagement with the lock members 212.

The package 200 is provided with frictional bosses 217. The back wall of the compartment formed in the bottle itself is formed with frictional recesses 218, registering with the bosses. In this way the secondary package may be inserted and frictionally retained within the compartment formed in the bottle.

By this means, the secondary item, whatever it is, can be pre-packaged in the secondary item container, and then the secondary item containers can be fed to the packaging line and installed by robotic arms (not shown) in the appropriate recesses in the appropriate bottles.

In the process of production, a robotic arm system (not shown) will pick up one secondary item package and move it into the secondary item recess in the primary package, and force the abutments into the appropriate recesses.

Figure 25:
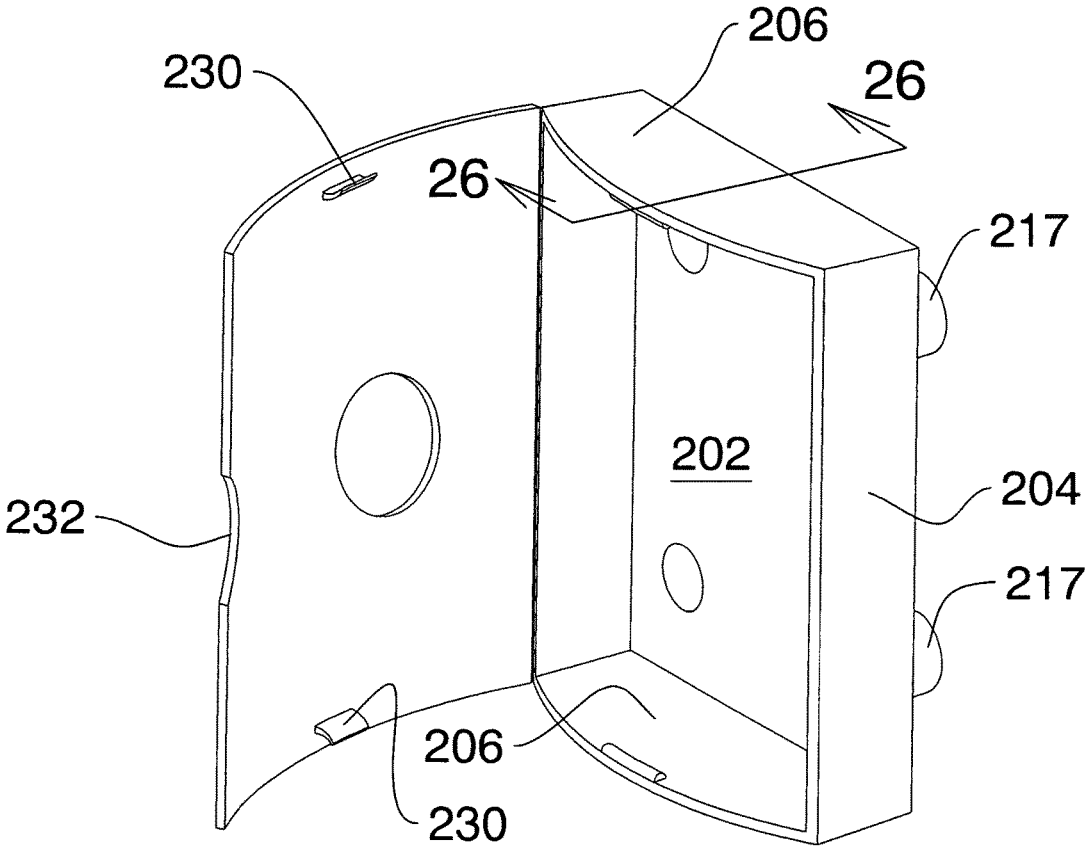
FIG. 25 is a perspective of a further embodiment of the secondary item compartment.
Figure 26:
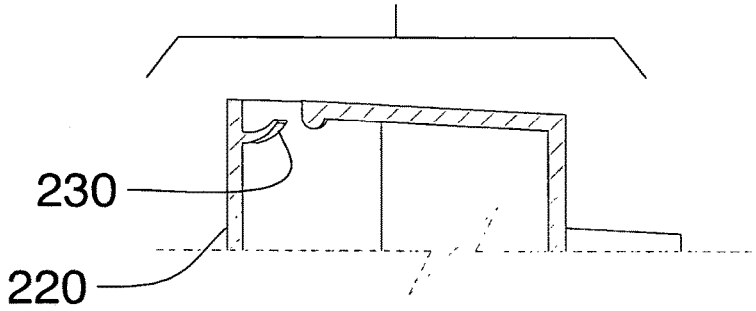
FIG. 26 is an enlarged detail of a portion of FIG. 25.

A further embodiment is shown in FIGS. 25 and 26. In this case the secondary item compartment has a similar configuration to the previous embodiment, but the front cover panel 220 is hinged at 224 along one side of the secondary item package. This makes for an easier form of closure, in this case, the top and bottom walls of the package, are formed with a curved profile, and the cover panel 220 is formed with a generally semi-cylindrical curved profile to simulate the curved profile of the primary container. In this case the panel is closed by means of abutments 230, formed on the cover panel.

In both embodiments, a finger opening 232 may be formed, so as to enable a consumer to readily open the secondary item package and obtain the contents.

Figure 27:
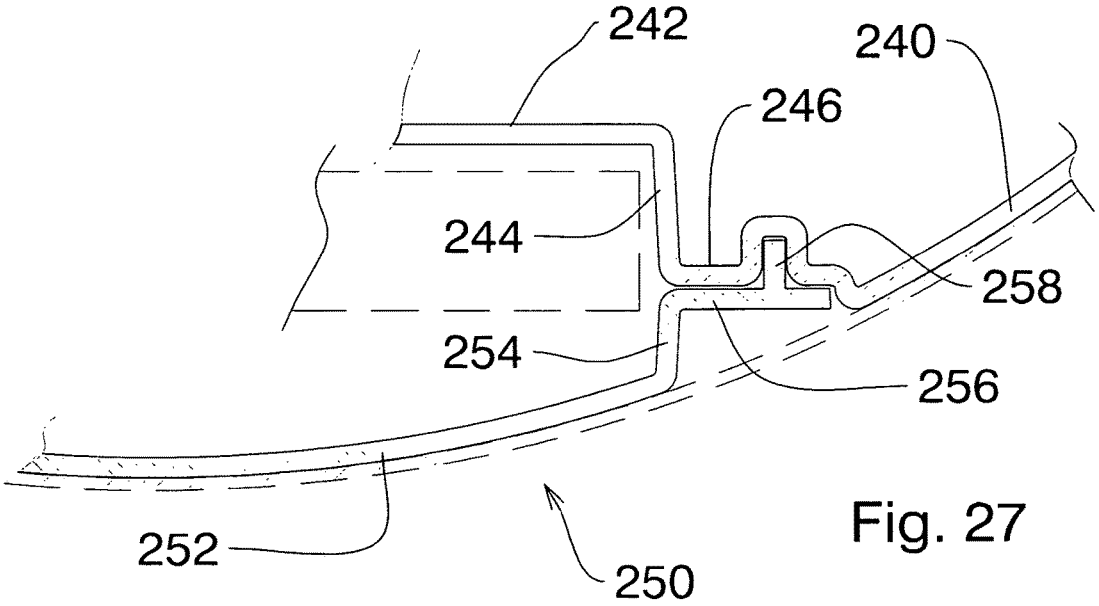
FIG. 27 is an exploded section of a further embodiment.
Figure 28:
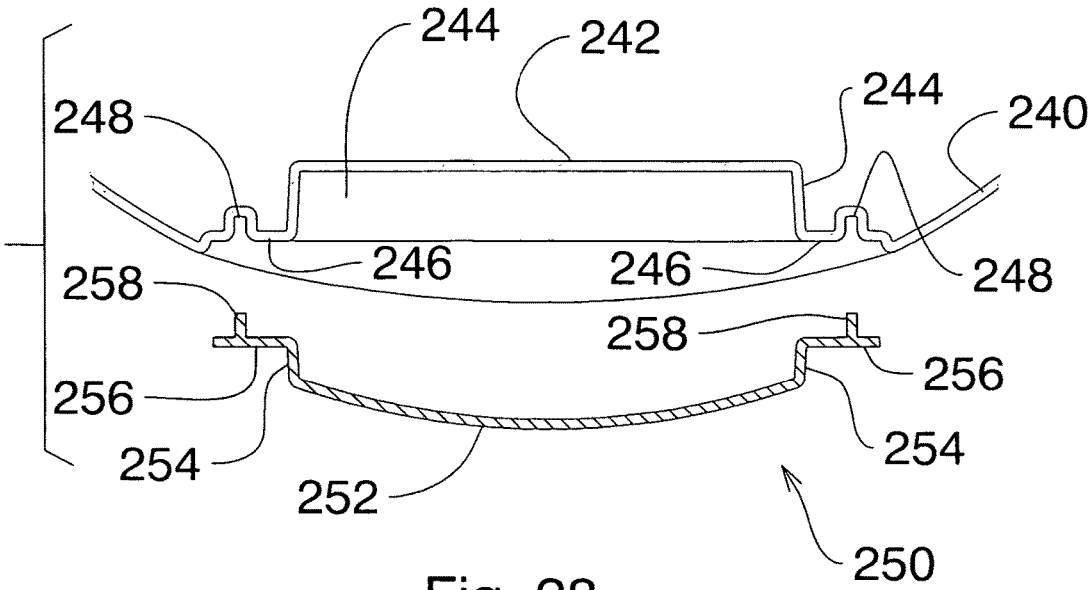
FIG. 28 is a section of the embodiment of FIG. 27, shown assembled.

A further embodiment is shown in FIGS. 27 and 28.

In this case, the bottle generally shown as 240 will have a recess formed in manufacture consisting of a recessed back wall 242 and side and end walls 244. Edge flanges 246, are formed in a common plane, along the edges of the side walls 244, and end walls, generally parallel to the plane of the back wall 242.

The edge flanges 246 are thus recessed somewhat relative to the surface profile of the bottle itself. Preferably this recessing will be at least equal to the thickness of the material used for the cover panel (described below).

Formed in the flanges 246, are pin recesses 248. Pin recesses 248 are formed to define axes which are normal to the plane of the flanges 246.

A promotional product or secondary item (not shown) can be placed in the recess defined by back wall 242 and side walls 244, and may be temporarily secured by adhesive or the like in the manner described above.

In order to close off the recess, and provide a smooth curved exterior for the bottle, a cover panel 250 is provided. Panel 250 defines a curved panel of material, defining an arc which is complementary to the arc of the shape of the bottle 240.

Side walls 254 extend around the edges of the panel 250. Fastening edges 256 are formed integrally with the side walls 254, and lie in a common plane.

Attachment pins 258 are formed on edges 256, and are located and oriented to register with recesses 248.

During the filling process of the bottle, or possibly prior to filling, the secondary product may be placed in the recess defined by the walls 242 and 244, and then the panel 250 will be attached, by registering the pins 258 with the recesses 248 and pressing them in, the result being shown in FIG. 28.

In this way, the bottle will be provided with as far as possible, a continuous smooth curved surface for receiving the usual label.

As will be understood from the above description, the orientation of the flanges 246, around the secondary product recess, and the side walls 254 along side the panel 250, all lie in contact with one another, along closely adjacent parallel planes. This is intended to ensure that during high speed assembly on a bottling line, for example, the cover panels 250 will be securely and repeatedly attached to respective bottles by means of their respective attachment pins 258 and recesses 248. It is understood that this arrangement leaves a slight gap or channel along each side of the cover panel, between the cover panel and the profile of the bottle surface. However, it is believed that the provision of a label which will be wrapped around the bottle, usually as the final act of assembly, will be sufficient to conceal this, and enable the bottle to offer an attractive and sellable appearance.

Any suitable finger opening may be provided in panel 250, to assist in opening the recess and removing the secondary item.

While what has been shown and described herein constitutes a preferred embodiment of the subject invention, it should be understood that various modifications and adaptations of such embodiment can be made without departing from the present invention, the scope of which is defined in the appended claims.

What is claimed is:

1. A combination container for a consumer product, for containing a primary consumer product and comprising; a body having an exterior side wall having an outer surface contour, the body defining a primary inner compartment for containing a primary consumer product, a secondary product compartment formed as a depression in the exterior side wall of the body, the secondary product compartment having side walls and a back wall defining a cavity recessed within the body; frictional recesses formed within the back wall of the cavity, a secondary product package dimensioned to fit within the secondary product compartment and having frictional projections for engaging within the frictional recesses of the cavity when the secondary product package is inserted into the cavity, secondary product within the secondary product package, a cover panel for covering the secondary product package and shaped to seat relative to the secondary product compartment side walls so that an exterior surface of the cover panel matches and conforms to the contour of the body exterior side wall, first interlocking mating formations formed in the secondary product compartment side walls, second interlocking mating formations formed on the cover panel wherein the first and second interlocking mating formations engage with one another when the cover panel is closed, and, a label wrapping around at least a portion of the exterior side wall of the body and the cover panel.

2. A combination container for a consumer product for containing a primary consumer product and comprising; a body having an exterior side wall having an outer surface contour, the body defining a primary inner compartment for containing a primary consumer product, a secondary product compartment formed as a depression in the exterior side wall of the body, the secondary product compartment having side walls and a back wall defining a cavity recessed within the body, a secondary product package of generally rectangular shape that is dimensioned to fit within the secondary product compartment and having top and bottom and opposite side walls and a back wall, a secondary product within the secondary product package, a cover panel for closing the secondary product package and having an exterior surface that matches and conforms to the contour of the exterior side wall of the body when the cover panel is in a closed position, wherein the cover panel is formed with a hinge along one edge thereof that is integral with the secondary product package, and first interlocking formation formed with one of the secondary product package side walls and second interlocking formation formed on the cover panel for cooperatively engaging with the first interlocking formation when the cover panel is closed relative to the side walls of the secondary product package, and, a label wrapping around at least a portion of the exterior side wall of the body and the cover panel.

3. The combination container for a consumer product as claimed in claim 2 wherein the cover panel is hinged to one of the side walls of the secondary product package.

4. The combination container for a consumer product as claimed in claim 2 wherein the first and second interlocking formations are lock members formed on the top and bottom side walls of the secondary product package and catch members formed on the cover panel that are engaged with the lock members to secure the cover panel closed relative to the secondary product package.

5. The combination container for a consumer product as claimed in claim 2, wherein the body is formed of paper and is of rectangular shape, and wherein the secondary product compartment is of rectangular shape recessed into the body.

6. The combination container for a consumer product as claimed in claim 5, wherein the secondary product compartment is formed of thermoplastic material separately from the body, and including side flanges on the secondary product compartment, the side flanges being bonded to an interior of the body, and an opening in the side wall of the body registering with the secondary product compartment.

7. The combination container for a consumer product as claimed in claim 2, wherein the container body is formed of paper and is of rectangular shape, and wherein the secondary product compartment is of rectangular shape recessed into the body.

8. The combination container for a consumer product as claimed in claim 7 wherein the secondary product compartment is formed of thermoplastic material separately from the container, and side flanges on the flanges on the secondary product compartment, the side flanges being bonded to the interior of the container, and an opening in the side wall of the container registering with the secondary compartment.

9. A combination container for a consumer product, for containing a primary consumer product and for carrying a secondary product separate from the primary product and comprising; a body having an exterior side wall having an outer surface contour and having a primary compartment for containing the primary consumer product, a secondary product compartment formed as a cavity recessed within the exterior side wall of the body and the cavity having opposite side walls and a back wall, recessed ledges formed in the opposite compartment side walls of the cavity, the recessed ledges lying in a common plane spaced inwardly from the exterior side wall of the body, the recessed ledges forming depressions into the body along either side of the secondary product compartment, a secondary product dimensioned to fit within the secondary product compartment, a cover panel for closing the secondary product compartment and shaped to match and conform to the contour exterior side wall of the body and dimensioned to fit on the recessed ledges, the cover panel having attachment side strips lying in common plane with one another, and making face to face contact with the recessed ledges, first interlocking formations formed in the recessed ledges of the secondary product compartment, second interlocking formations formed on the cover panel for engaging with the first interlocking formations for securing the cover panel in a closed relationship covering the second product compartment, and, a label covering portions of the exterior side wall of the body and the cover panel.

10. The combination container for a consumer product as claimed in claim 9 wherein the first interlocking formations are recesses formed in the recessed ledges and the second interlocking formations are projections formed on the cover panel of a size to be frictionally received within the recesses in the recessed ledges when the cover panel is closed over the second product compartment.

* * * * *